US008203508B2

(12) United States Patent
Yang

(10) Patent No.: US 8,203,508 B2
(45) Date of Patent: Jun. 19, 2012

(54) PLASMA DISPLAY DEVICE AND DRIVING METHOD THEREOF

(75) Inventor: Jinho Yang, Yongin-Si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 987 days.

(21) Appl. No.: 12/187,277

(22) Filed: Aug. 6, 2008

(65) Prior Publication Data

US 2009/0039792 A1 Feb. 12, 2009

(30) Foreign Application Priority Data

Aug. 8, 2007 (KR) ..... 10-2007-0079761

(51) Int. Cl.
*G09G 3/28* (2006.01)

(52) U.S. Cl. ..... 345/69; 345/60

(58) Field of Classification Search ..... 345/60, 345/69

See application file for complete search history.

(56) References Cited

U.S. PATENT DOCUMENTS

| | | | | |
|---|---|---|---|---|
| 5,745,086 | A | 4/1998 | Weber | |
| 7,170,472 | B2 * | 1/2007 | Park et al. | 345/68 |
| 7,358,968 | B2 * | 4/2008 | Sasada et al. | 345/204 |
| 2005/0030260 | A1 | 2/2005 | Kim et al. | |
| 2005/0083259 | A1 | 4/2005 | Kim et al. | |
| 2005/0200566 | A1 | 9/2005 | Kim et al. | |
| 2005/0280024 | A1 | 12/2005 | Kim et al. | |
| 2007/0057870 | A1 | 3/2007 | Kamada et al. | |

FOREIGN PATENT DOCUMENTS

| | | | |
|---|---|---|---|
| EP | 1 492 076 | A2 | 12/2004 |
| JP | 2005-018045 | | 1/2005 |
| JP | 2005-331952 | | 12/2005 |
| KR | 10-2003-0025542 | | 3/2003 |
| KR | 10-2005-0036626 | | 4/2005 |
| KR | 10-2006-0021235 | | 3/2006 |
| KR | 10-0581965 | | 5/2006 |
| KR | 1020060092028 | A | 8/2006 |

OTHER PUBLICATIONS

Korean Patent Abstracts, Publication No. 100581965, dated May 15, 2006, in the name of Jin Boo Son.

* cited by examiner

*Primary Examiner* — Amare Mengistu
*Assistant Examiner* — Aaron M Guertin
(74) *Attorney, Agent, or Firm* — Christie, Parker & Hale, LLP

(57) ABSTRACT

A plasma display device includes a plasma display panel having a scan driver including a falling reset signal/scan low signal generating circuit that includes: a first switch coupled to a scan electrode, a second switch coupled in series with the first switch and coupled to a scan low voltage source having a scan low voltage, a first driving circuit having an output terminal coupled to a control terminal of the first switch and a ground terminal coupled to the first and second switches, a second driving circuit having an output terminal coupled to a control terminal of the second switch and a ground terminal coupled to the second switch and the scan low voltage source, a control Zener diode between the control terminals of the first and second switches, and a control resistor between the control terminal of the second switch and the scan low voltage source.

13 Claims, 12 Drawing Sheets

PLASMA DISPLAY DEVICE AND DRIVING METHOD THEREOF

CROSS-REFERENCE TO RELATED APPLICATION

This application claims priority to and the benefit of Korean Patent Application No. 10-2007-0079761, filed on Aug. 8, 2007, the entire content of which is incorporated herein by reference.

BACKGROUND OF THE INVENTION

1. Field of the Invention

The present invention relates to a plasma display device, and more particularly, to a plasma display device and a driving method thereof.

2. Description of the Related Art

A plasma display device is a display device using a plasma display panel that displays text or images by using plasma produced by a gas discharge. A plurality of discharge cells is arranged on the plasma display panel in the form of a matrix.

The display panel of such a plasma display device is driven in a way that one frame is divided into a plurality of subfields having respective weight values. Furthermore, each subfield includes a reset period, an address period and a sustain period. The reset period is a period that initializes the discharge cells for stably performing an address discharge. The address period is a period that performs address discharges for selecting turned-on cells and non-turned-on cells from the display panel. Furthermore, the sustain period is a period that performs sustain discharges for displaying an image using the turned-on cells.

A conventional plasma display device applies a rising reset signal and a falling reset signal to scan electrodes so as to initialize the discharge cells during the reset period, applies a scan low signal to the scan electrodes for address discharges during the address period, and applies sustain signals to the scan electrodes for sustain discharges during the sustain period.

To this end, the conventional plasma display device includes a Vs voltage source which supplies a Vs voltage that is a high voltage and a Ypn switch coupled between the Vs voltage source and the scan electrode so as to apply a rising reset signal for increasing a voltage of the scan electrode to the Vs voltage (positive polarity voltage) during a rising period of the reset period to the scan electrode. The conventional plasma display device also includes a VscL voltage source which supplies a VscL voltage of a low voltage and a switch Yfr for a falling reset signal, and a switch YscL for a scan low signal which are coupled in parallel with each other between the VscL voltage source and the scan electrode. The switch Yfr is used to apply a falling reset signal for decreasing a voltage of the scan electrode from the Vs voltage to a Vnf voltage (negative polarity voltage) to the scan electrode during a falling period of the reset period, and the switch YscL is used to apply a scan low signal having a VscL voltage (negative polarity voltage) to the scan electrode during the address period.

As described above, in a conventional plasma display device, if the Ypn switch is turned off after a rising reset signal for increasing a voltage of the scan electrode to the Vs voltage during a rising period of the reset period is applied to the scan electrode, then a voltage Vs−VscL applied between the ends of both the switch Yfr for a falling reset signal and the switch YscL for a scan low signal that are coupled in parallel with each other between the scan electrode and the VscL voltage source is, for example, 200V−(−200V)=400V. Hence, the switch Yfr for applying the falling reset signal and the switch YscL for applying the scan low signal should be a switch whose withstanding voltage of Vs−VscL is, for example, 400V or more. However, such a switch having a high withstanding voltage is expensive, and thus it increases the manufacturing cost of a plasma display device.

Further, in order to facilitate an address discharge, a conventional plasma display device further includes a Zener diode which is coupled to the switch Yfr for a falling reset signal in series and is coupled to the switch YscL for a scan low signal in parallel so that a voltage of a falling reset signal is higher than a voltage of a scan low signal by more than a certain voltage. In other words, the Vnf voltage is higher than the VscL voltage by a certain voltage (that is, since a breakdown voltage of the Zener diode is the same as a certain voltage difference ΔV between a Vnf voltage and a VscL voltage, the Vnf voltage is higher than the VscL voltage by the breakdown voltage of the Zener diode.). As described above, because the Zener diode is positioned between the scan electrode and the VscL voltage source, a large current flowing between the scan electrode and the VscL voltage source passes through the Zener diode when the falling reset signal is applied to the scan electrode. Hence, a Zener diode having a high electric power, for example, 3 W or more should be used as the Zener diode through which a large current passes. However, a Zener diode having a high electric power is also expensive, and thus it increases the manufacturing cost of a plasma display device.

SUMMARY OF THE INVENTION

An aspect according to an exemplary embodiment of the present invention is to provide a plasma display device and a driving method thereof that can suppress the increase in manufacturing cost caused by the use of a switch having high withstanding voltage by reducing a withstanding voltage of a switch coupled between a scan electrode to which a high voltage is applied and a low voltage source having a low voltage.

A plasma display device according to an exemplary embodiment of the present invention includes a plasma display panel that has a plurality of scan electrodes and a scan driver which is coupled to the scan electrodes. The scan driver includes a falling reset signal/scan low signal generating circuit that includes a first switch electrically coupled to a scan electrode among the plurality of scan electrodes, a second switch coupled in series with the first switch, a scan low voltage source having a scan low voltage and electrically coupled to the second switch, a first driving circuit which has an output terminal electrically coupled to a control terminal of the first switch and a ground terminal electrically coupled to a connection point of the first switch and the second switch, a second driving circuit which has an output terminal electrically coupled to a control terminal of the second switch and a ground terminal electrically coupled to a connection point of the second switch and the scan low voltage source, a control Zener diode electrically coupled between the control terminal of the first switch and the control terminal of the second switch, and a control resistor electrically coupled between the control terminal of the second switch and the scan low voltage source.

A first terminal of the first switch may be electrically coupled to the scan electrode, and a second terminal of the first switch may be electrically coupled to a first terminal of the second switch and the ground terminal of the first driving circuit, and the control terminal of the first switch may be electrically coupled to the output terminal of the first driving circuit and a cathode of the control Zener diode.

A second terminal of the second switch may be electrically coupled to the ground terminal of the second driving circuit and the control resistor, and the control terminal of the second switch may be electrically coupled to an anode of the control Zener diode and the resistor.

The first driving circuit may have an input terminal, and when a high-level signal is inputted through the input terminal of the first driving circuit, an operation voltage, which is a voltage difference between the output terminal and the ground terminal of the first driving circuit, may be applied to the first switch, so that the first switch may be turned on. Furthermore, the second driving circuit may have an input terminal, and when a high-level signal is inputted through the input terminal of the second driving circuit, an operation voltage, which is a voltage difference between the output terminal and the ground terminal of the second driving circuit, may be applied to the second switch, so that the second switch may be turned on.

The operation voltage of the first driving circuit may be higher than a threshold voltage of the first switch, and the operation voltage of the second driving circuit may be higher than a threshold voltage of the second switch.

Further, a plasma display device according to an exemplary embodiment of the present invention may further include a first voltage source having a first voltage and electrically coupled to the first terminal of the first switch and the scan electrode, and a main control switch which is electrically coupled between the first voltage source and the first terminal of the first switch.

During a rising period of a reset period, the main control switch may be turned on, so that the first voltage may be applied to the scan electrode.

During a falling period of the reset period, in such a state that the main control switch is turned off and the first switch is turned on by the first driving circuit, the turn-on and turn-off actions of the second switch may be repeated, and a voltage of the first terminal of the second switch may be constantly maintained, and a falling reset signal decreasing from the first voltage to a second voltage may be applied to the scan electrode.

The second voltage may be a voltage increased by a voltage between the first terminal and the second terminal of the second switch from the scan low voltage, and the voltage between the first terminal and the second terminal of the second switch may be a voltage produced by subtracting the operation voltage of the first driving circuit from a voltage between ends of the control Zener diode added to a threshold voltage of the second switch.

During an address period, the second switch may be turned on by the second driving circuit, so that a scan low signal having the scan low voltage may be applied to the scan electrode.

The falling reset signal/scan low signal generating circuit may further include a ramp generating circuit which has a first terminal electrically coupled to the scan electrode and the first terminal of the first switch, a second terminal electrically coupled to the control terminal of the first switch, and a third terminal electrically coupled to the output terminal of the first driving circuit and the cathode of the control Zener diode.

The ramp generating circuit may include a resistor electrically coupled to the first terminal of the first switch and a capacitor electrically coupled between the resistor and the control terminal of the first switch.

The falling reset signal/scan low signal generating circuit may further include a diode which has an anode electrically coupled to the control terminal of the first switch and the second terminal of the ramp generating circuit and has a cathode electrically coupled to the cathode of the control Zener diode and the third terminal of the ramp generating circuit.

The falling reset signal/scan low signal generating circuit may further include a diode for high impedance which is electrically coupled between the output terminal of the second driving circuit and the control Zener diode.

The falling reset signal/scan low signal generating circuit may further include a switch for high impedance which is electrically coupled between the output terminal of the second driving circuit and the control Zener diode.

Another plasma display device according to an exemplary embodiment of the present invention may include a plasma display panel having a plurality of scan electrodes and a scan driver which is coupled to the scan electrode and includes a falling reset signal/scan low signal generating circuit. The falling reset signal/scan low signal generating circuit may include a first switch electrically coupled to a scan electrode among the plurality of scan electrodes, a second switch coupled in series with the first switch, a scan low voltage source which has a scan low voltage and is electrically coupled to the second switch, a first driving circuit which has an output terminal electrically coupled to a control terminal of the first switch and a ground terminal electrically coupled to a connection point of the first switch and the second switch, a second driving circuit which has an output terminal electrically coupled to a control terminal of the second switch and a ground terminal electrically coupled to a connection point of the second switch and the scan low voltage source, a control Zener diode electrically coupled between the ground terminal of the first driving circuit and the control terminal of the second switch, a control resistor electrically coupled between the control terminal of the second switch and the scan low voltage source, and a diode for preventing a countercurrent which is electrically coupled between the ground terminal of the first driving circuit and the control Zener diode.

A first terminal of the first switch may be electrically coupled to the scan electrode, and a second terminal of the first switch may be electrically coupled to a first terminal of the second switch and the ground terminal of the first driving circuit.

A first terminal of the second switch may be electrically coupled to the second terminal of the first switch and a cathode of the control Zener diode, and a second terminal of the second switch may be electrically coupled to the ground terminal of the second driving circuit and the control resistor, and the control terminal of the second switch may be electrically coupled to an anode of the control Zener diode and the resistor.

An anode of the diode for preventing a countercurrent may be electrically coupled to the ground terminal of the first driving circuit and the second terminal of the first switch, and a cathode of the diode for preventing a countercurrent may be electrically coupled to the cathode of the control Zener diode.

The first driving circuit may have an input terminal, and when a high-level signal is inputted through the input terminal of the first driving circuit, an operation voltage which is a voltage difference between the output terminal and the ground terminal of the first driving circuit may be applied to the first switch, so that the first switch may be turned on. Furthermore, the second driving circuit may have an input terminal, and when a high-level signal is inputted through the input terminal of the second driving circuit, an operation voltage which is a voltage difference between the output terminal and the ground terminal of the second driving circuit may be applied to the second switch, so that the second switch may be turned on.

Another plasma display device according to an exemplary embodiment of the present invention may further include a first voltage source having a first voltage and electrically coupled to the first terminal of the first switch and the scan electrode, and a main control switch which is electrically coupled between the first voltage source and the first terminal of the first switch.

During a rising period of a reset period, the main control switch may be turned on, so that the first voltage may be applied to the scan electrode.

During a falling period of the reset period, when the main control switch is turned off and the first switch is turned on by the first driving circuit, the turn-on and turn-off actions of the second switch may be repeated, and a voltage of the first terminal of the second switch may be constantly maintained, and a falling reset signal decreasing from the first voltage to a second voltage may be applied to the scan electrode.

The second voltage may be a voltage increased by a voltage between the first terminal and the second terminal of the second switch from the scan low voltage, and the voltage between the first terminal and the second terminal of the second switch may be a voltage produced by adding a voltage between ends of the control Zener diode and a threshold voltage of the second switch.

During an address period, the second switch may be turned on by the second driving circuit, so that a scan low signal having the scan low voltage may be applied to the scan electrode.

The falling reset signal/scan low signal generating circuit may further include a ramp generating circuit which has a first terminal electrically coupled to the scan electrode and the first terminal of the first switch, a second terminal electrically coupled to the control terminal of the first switch, and a third terminal electrically coupled to the output terminal of the first driving circuit.

The ramp generating circuit may include a resistor electrically coupled to the first terminal of the first switch and a capacitor electrically coupled between the resistor and the control terminal of the first switch.

The falling reset signal/scan low signal generating circuit may further include a diode which has an anode electrically coupled to the control terminal of the first switch and the second terminal of the ramp generating circuit and has a cathode electrically coupled to the output terminal of the first driving circuit and the third terminal of the ramp generating circuit.

The falling reset signal/scan low signal generating circuit may further include a diode for high impedance which is electrically coupled between the output terminal of the second driving circuit and the control Zener diode.

The falling reset signal/scan low signal generating circuit may further include a switch for high impedance which is electrically coupled between the output terminal of the second driving circuit and the control Zener diode.

A driving method of a plasma display device including a plurality of scan electrodes adapted to receive a first voltage and electrically coupleable to a scan low voltage source having a scan low voltage, according to an exemplary embodiment of the present invention, is provided. The method includes turning on a first switch electrically coupled between a scan electrode among the plurality of scan electrodes and the scan low voltage source, repeatedly turning on and off a second switch which is coupled in series with the first switch between the scan electrode and the scan low voltage source to apply a falling reset signal which decreases from the first voltage to a second voltage to the scan electrode, and turning on the second switch and applying a scan low signal having the scan low voltage which is lower than the second voltage to the scan electrode.

When the first switch is turned on, the first switch which has a first terminal coupled to the scan electrode, a second terminal coupled to a ground terminal of a first driving circuit and a control terminal coupled to an output terminal of the first driving circuit is turned on by an operation voltage which is a voltage difference between the output terminal and the ground terminal of the first driving circuit.

The repeatedly turning on and off may include applying a current flowing from a cathode to an anode of a control Zener diode to a control terminal of the second switch which has a first terminal coupled between the second terminal of the first switch and the ground terminal of the first driving circuit, a second terminal coupled between a ground terminal of a second driving circuit and the scan low voltage source and the control terminal coupled between the anode of the control Zener diode having the cathode coupled between a control terminal of the first switch and the output terminal of the first driving circuit and an output terminal of the second driving circuit, and then the second switch is turned on, and discharging the current flowing from the cathode to the anode of the control Zener diode through a control resistor electrically coupled between the control terminal of the second switch and a second terminal of the second switch, and then the second switch is turned off.

The second switch may be turned on by the operation voltage which is a voltage difference between the output terminal and the ground terminal of the second driving circuit.

Furthermore, said repeatedly turning on and off the second switch may include applying a current flowing through a control Zener diode and a diode for preventing a countercurrent, which has an anode coupled between the second terminal of the first switch and the ground terminal of the first driving circuit and has a cathode coupled to a cathode of the control Zener diode, to a control terminal of the second switch which has a first terminal coupled between the second terminal of the first switch and the ground terminal of the first driving circuit, a second terminal coupled between a ground terminal of a second driving circuit and the scan low voltage source and the control terminal coupled between the anode of the control Zener diode having the cathode coupled between the second terminal of the first switch and the ground terminal of the first driving circuit, and an output terminal of the second driving circuit, and the second switch is turned on, and discharging the current flowing through the diode for preventing a countercurrent and the control Zener diode through a control resistor electrically coupled between the control terminal of the second switch and a second terminal of the second switch, and the second switch is turned off.

BRIEF DESCRIPTION OF THE DRAWINGS

The above and other aspects and features of the present invention will be more apparent from the following detailed description taken in conjunction with the accompanying drawings, in which.

DETAILED DESCRIPTION OF THE EMBODIMENTS

Hereinafter, exemplary embodiments of the present invention will be described with reference to the accompanying drawings.

It should be understood throughout the specification that "coupling" between a certain element and another element includes "direct coupling" between them as well as "indirect coupling" between them through an interposed element. Moreover, unless otherwise specified, when a certain part is referred to as "including" a certain element, it is not meant to exclude other elements in the certain part.

Figure 1:
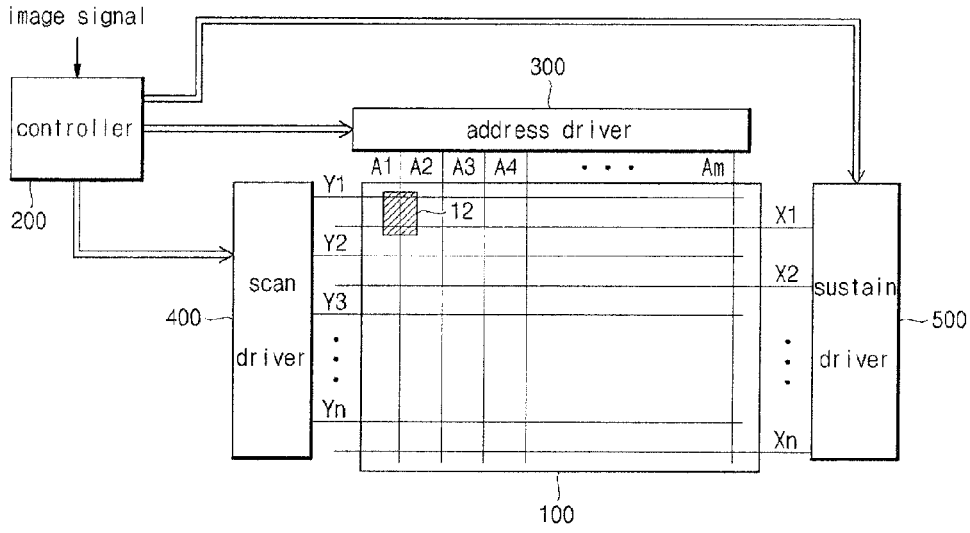
FIG. 1 is a schematic block diagram of a plasma display device according to an embodiment of the present invention.

FIG. 1 is a schematic block diagram of a plasma display device according to an embodiment of the present invention.

Referring to FIG. 1, a plasma display device according to an embodiment of the present invention includes a plasma display panel 100, a controller 200, an address driver 300, a scan driver 400 and a sustain driver 500.

The plasma display panel 100 includes a plurality of address electrodes A1 to Am (hereinafter referred to as "A electrodes") extending in the column direction, a plurality of sustain electrodes X1 to Xn (hereinafter referred to as "X electrodes") extending in the row direction, and scan electrodes Y1 to Yn (hereinafter referred to as "Y electrodes") also extending in the row direction. Each of the X electrodes forms a pair with a corresponding one of the Y electrodes. Generally, the X electrodes X1 to Xn are formed corresponding to the respective Y electrodes Y1 to Yn, and the X electrodes and the Y electrodes perform a display operation for displaying an image during a sustain period. The Y electrodes Y1 to Yn and the X electrodes X1 to Xn are arranged to be orthogonal to the A electrodes A1 to Am. A discharge space which is positioned at each crossing region of the A electrodes A1 to Am and the X electrodes X1 to Xn and the Y electrodes Y1 to Yn forms a cell 12. The structure of the plasma display panel 100 has been described as an example, but panels having other structures, to which a driving waveform to be described later can be applied, can also be applied to embodiments of the present invention.

The controller 200 receives an image signal from the outside and outputs an address control signal, a sustain control signal and a scan control signal. Furthermore, the controller 200 drives by dividing one frame into a plurality of subfields, each subfield including a reset period, an address period and a sustain period.

The address driver 300 supplies display data signals for selecting discharge cells to be displayed to the respective A electrodes A1 to Am in response to the address control signal received from the controller 200.

The scan driver 400 applies driving voltages to the Y electrodes Y1 to Yn in response to the scan control signal received from the controller 200.

The sustain driver 500 applies driving voltages to the X electrodes X1 to Xn in response to the sustain control signal received from the controller 200.

Figure 2:
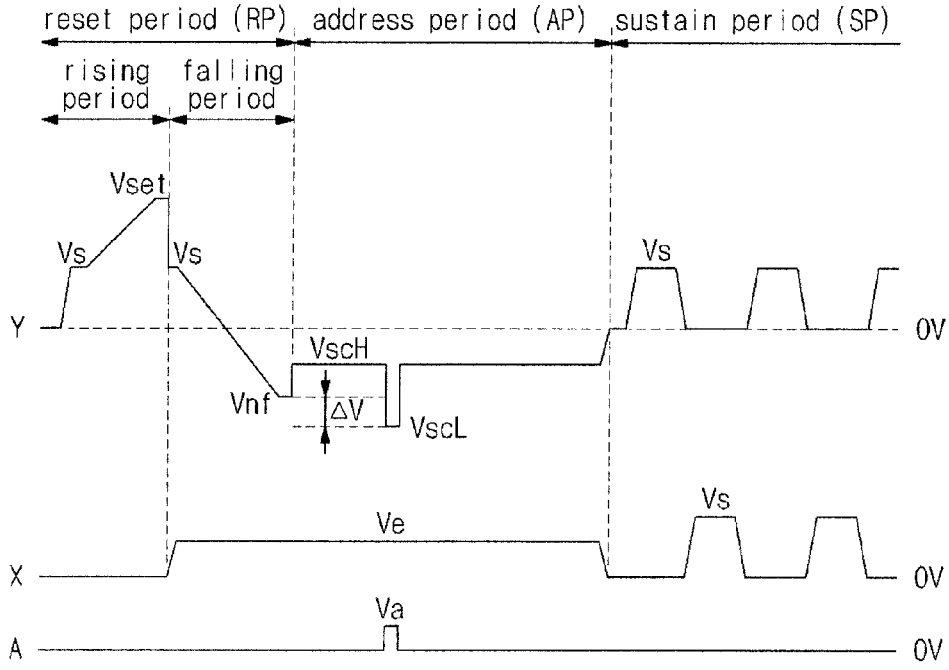
FIG. 2 is a waveform diagram of a driving waveform for driving a panel of the plasma display device of FIG. 1.

FIG. 2 is a waveform diagram of a driving waveform of the plasma display device of FIG. 1.

Hereinafter, only the description of a driving waveform which is applied to a Y electrode, an X electrode and an A electrode forming one cell will be provided for convenience. Furthermore, a cell 12 in which a sustain discharge occurs during a sustain period will be referred to as a light emitting cell, and a cell in which a sustain discharge does not occur during a sustain period will be referred to as a non-light emitting cell.

As illustrated in FIG. 2, the plasma display panel 100 displays an image (e.g., a predetermined image) by sequentially performing a reset period RP, an address period AP and a sustain period SP in one subfield SF.

The reset period RP of one subfield can be composed of a rising period and a falling period.

In the rising period of the reset period RP, a rising reset signal which is gradually increased from a Vs voltage (or a first voltage) which is, for example, 200 volts, to a Vset voltage which is, for example, 395 volts, is applied to the Y electrode. At this time, a ground voltage (0V in FIG. 2) is applied to the X electrode and the A electrode. Hence, a weak discharge occurs between the Y electrode and the X electrode, and a weaker discharge occurs between the Y electrode and the A electrode. By this weak discharge, a negative wall charge is formed on the Y electrode, and a positive wall charge is formed on the X electrode and the A electrode. Furthermore, when a voltage of the Y electrode is gradually varied as FIG. 2, a weak discharge occurs in a cell, and a wall charge is formed so that the sum of a voltage applied from the outside and a wall voltage of the cell maintains a firing voltage state. Such a principle is disclosed in the U.S. Pat. No. 5,745,086 by Weber. Because the state of all cells should be initialized in the reset period RP, the Vset voltage is a high voltage that allows cells under all conditions to be discharged.

Next, in the falling period of the reset period RP, a falling reset signal which is continuously decreased from a Vs voltage to a Vnf voltage (or a second voltage) which is, for example, −175 volts, is applied to the Y electrode while a voltage applied to the X electrode is maintained at a Ve voltage. At this time, a ground voltage (0V) is maintained at the A electrode. Then, while a voltage of the Y electrode is decreased, a weak discharge occurs between the Y electrode and the X electrode and between the Y electrode and the A electrode, and a negative wall charge formed on the Y electrode and a positive wall charge formed on the X electrode and the A electrode are eliminated. Generally, the magnitude of $|Vnf-Ve|$ is set to the vicinity of a firing voltage between the Y electrode and the X electrode. Then, a wall voltage between the Y electrode and the X electrode is approximately 0 volt, so that it is possible to prevent a cell in which an address discharge does not occur in the address period from erroneously discharging in the sustain period SP. FIG. 2 illustrates a reset signal waveform in the shape of a ramp, but other reset signal waveforms having other shapes and performing the same or similar function can be used instead.

In the following address period AP, in order to select a light emitting cell, scan low signals having a VscL voltage (a scan low voltage or a third voltage) are sequentially applied to a plurality of Y electrodes while the Ve voltage is applied to the X electrode. At this time, a Va voltage is applied to the A electrode which passes through a light emitting cell to be selected from a plurality of light emitting cells formed by the Y electrodes to which the VscL voltage is applied. Then, a positive wall charge is formed on the Y electrode, and a negative wall charge is formed on the X electrode. Furthermore, a negative wall charge is also formed on the A electrode. Here, the VscL voltage can be set to the Vnf voltage or can be set to a lower level than the Vnf voltage, but in one embodiment is set to a lower level than the Vnf voltage. When the VscL voltage is set to a lower level than the Vnf voltage by a certain voltage (ΔV), a voltage difference |VscL−Va| between the Y electrode and the A electrode becomes large, so that an address discharge occurs well. Furthermore, a VscH voltage which is higher than the VscL voltage is applied to the Y electrode to which the VscL voltage is not applied, and a ground voltage (0V) is applied to the A electrode of a non-light emitting cell which is not selected. In order to perform such an operation in the address period AP, the scan driver 400 selects a Y electrode among the Y electrodes Y1 to Yn to which the scan low signal having the VscL voltage is to be applied. For example, in a single driving method, it is possible to select the Y electrodes in accordance with their vertical arrangement order. Furthermore, in case where one Y electrode is selected, the address driver 300 selects a light emitting cell among discharge cells formed by the Y electrodes. In other words, the address driver 300 selects a cell among the A electrodes A1 to Am to which an address signal having a Va voltage is to be applied. The address period AP is performed by discharging a cell having a non-light emitting cell state, forming a wall charge on the cell, and setting the cell to a light emitting cell state.

Next, in the sustain period SP, a sustain signal alternately having a Vs voltage and a ground voltage (0V) is applied with inverse phase to the Y electrode and the X electrode while applying a ground voltage (0V) to the A electrode, so that a sustain discharge occurs between the Y electrode and the X electrode. Thereafter, a process of applying a sustain signal having a Vs voltage to the Y electrode and a process of applying a sustain signal having a Vs voltage to the X electrode are repeated by the number of times that corresponds to a weight value displayed by a corresponding subfield. In FIG. 2, a high level of the sustain signal is illustrated as a Vs voltage, and a low level of the sustain signal is illustrated as a ground voltage (0V), but the present invention is not limited thereto. For example, it is also possible to use a low level of the sustain signal as a negative polarity sustain voltage −Vs.

Figure 3:
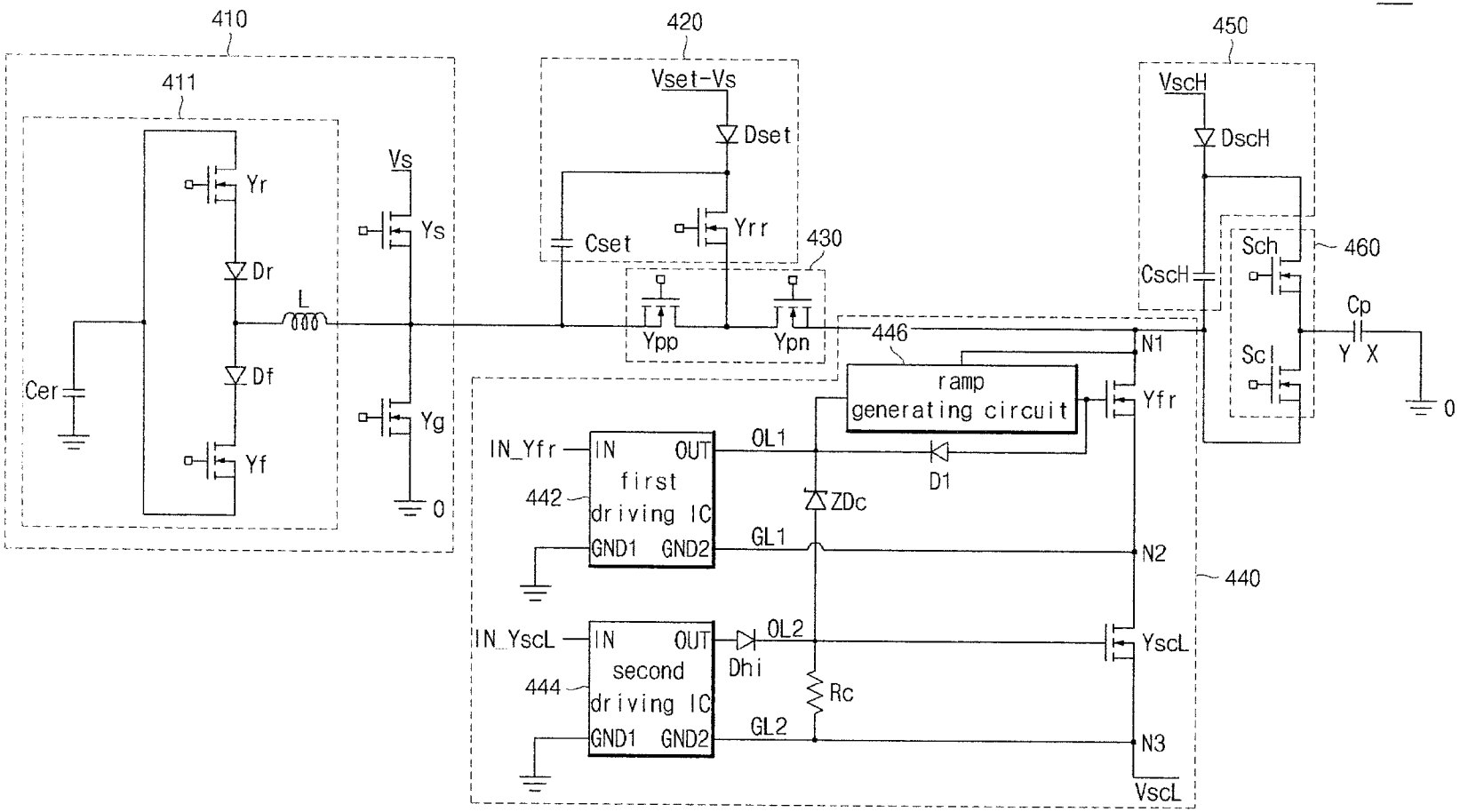
FIG. 3 is a circuit diagram of a scan driver of FIG. 1.

FIG. 3 is a circuit diagram of the scan driver of FIG. 1.

As illustrated in FIG. 3, the scan driver 400 of the plasma display device according to an embodiment of the present invention includes a sustain signal generating circuit 410, a rising reset signal generating circuit 420, a switching circuit 430, a falling reset signal/scan low signal generating circuit 440, a scan high signal generating circuit 450, and a selection circuit 460.

In FIG. 3, a capacitive element formed by the Y electrode adjacent to the X electrode is illustrated as a panel capacitor Cp, and the X electrode of the panel capacitor Cp is biased to a ground voltage. Furthermore, a switching element to be described later is illustrated as an n-channel transistor that may be a field effect transistor (FET) having a body diode or other switching elements performing the same or similar function.

The sustain signal generating circuit 410 includes switches Ys and Yg and an energy recovery circuit 411, applies a Vs voltage to the Y electrode during a rising period of the reset period RP and the sustain period SP, and applies 0V to the Y electrode during the sustain period SP. The energy recovery circuit 411 includes switches Yr and Yf, an inductor L, diodes Dr and Df, and a capacitor Cer.

The transistor Ys is coupled between a Vs voltage source (or first voltage source) for supplying a Vs voltage and the Y electrode of the panel capacitor Cp, and the switch Yg is coupled between a 0V voltage source for supplying the 0V voltage and the Y electrode of the panel capacitor Cp. In this case, the switch Ys applies a Vs voltage to the Y electrode, and the switch Yg applies the 0V voltage to the Y electrode.

A first terminal of the capacitor Cer is coupled to the contact point (i.e., the connection point) of the switches Ys and Yg, and the capacitor Cer is charged with a half voltage Vs/2 between the Vs voltage and the 0V voltage. Furthermore, a source terminal of the switch Yr is coupled to a second terminal of the inductor L having a first terminal coupled to the Y electrode, and a drain terminal of the switch Yr is coupled to the first terminal of the capacitor Cer, and a drain terminal of the switch Yf is coupled to the second terminal of the inductor L, and a source terminal of the switch Yf is coupled to the first terminal of the capacitor Cer.

Furthermore, the diode Dr is coupled between the source terminal of the switch Yr and the inductor L, and the diode Df is coupled between the drain terminal of the switch Yf and the inductor L. The diode Dr is to set a rising path along which a voltage of the panel capacitor Cp is increased when the switch Yr has a body diode, and the diode Df is to set a falling path along which a voltage of the Y electrode is decreased when the switch Yf has a body diode. If the switches Yr and Yf do not have body diodes, then the diodes Dr and Df can be removed. The energy recovery circuit 411 as coupled above increases a voltage of the Y electrode from the 0V voltage to the Vs voltage or decreases a voltage of the Y electrode from the Vs voltage to the 0V voltage by using the resonance of the inductor L and the panel capacitor Cp.

The connection order among the inductor L, the diode Df and the switch Yf in the energy recovery circuit 411 can be changed, and the connection order among the inductor L, the diode Dr and the switch Yr in the energy recovery circuit 411 can also be changed. For example, the inductor L can also be coupled between a contact point (i.e., the connection point) of the switches Yr and Yf and the capacitor Cer for recovering energy. Furthermore, the inductor L is coupled to the contact point (i.e., the connection point) between the switches Yr and Yf in FIG. 3, but two inductors can be respectively included in a rising path formed by the switch Yr and a falling path formed by the switch Yf.

The rising reset signal generating circuit 420 includes a switch Yrr, a capacitor Cset and a diode Dset and applies a rising reset signal which is gradually increased from the Vs voltage to the Vset voltage to the Y electrode in a rising period of the reset period RP. The switching circuit 430 includes main control switches Ypp and Ypn and controls the applications of the Vs voltage and the 0V voltage of the sustain signal generating circuit 410 and the Vset−Vs voltage of the rising reset signal generating circuit 420 to the Y electrode.

A source terminal of the switch Yrr that has a drain terminal coupled to a Vset−Vs voltage source for supplying a Vset−Vs voltage is coupled to the Y electrode, and a source terminal of the main control switch Ypn that has a drain terminal coupled to the source terminal of the switch Yrr is coupled to the Y electrode. Furthermore, a source terminal of the main control switch Ypp that has a drain terminal coupled to the source terminal of the switch Yrr is coupled to the contact point (i.e., the connection point) between the switches Ys and Yg. The capacitor Cset is coupled between the source terminal of the main control switch Ypp and the drain terminal of the switch Yrr, and the capacitor Cset is charged with the Vset−Vs voltage when the switch Yg is turned on. Furthermore, in order to cut off the current due to a body diode of the switch Yrr, the diode Dset is coupled to the switch Yrr in the direction opposite to the body diode.

The falling reset signal/scan low signal generating circuit 440 includes a first switch Yfr, a second switch YscL, a VscL voltage source (a scan low voltage source or a second voltage source), a first driving IC 442, a second driving IC 444, a control Zener diode ZDc, a control resistor Rc, and a ramp generating circuit 446. Furthermore, the falling reset signal/scan low signal generating circuit 440 can further include a diode D1 and a diode Dhi for high impedance. The falling reset signal/scan low signal generating circuit 440 applies a falling reset signal which is gradually decreased from the Vs voltage to the Vnf voltage to the Y electrode in a falling period of the reset period RP and applies a scan low signal having the VscL voltage to the Y electrode of a discharge cell to be turned on in the address period AP.

The first switch Yfr and the second switch YscL are coupled in series between the VscL voltage source having the VscL voltage and the Y electrode of the panel capacitor Cp. More specifically, a drain terminal (or a first terminal) of the first switch Yfr is electrically coupled to the Y electrode of the panel capacitor Cp, and a source terminal (or a second terminal) of the first switch Yfr is electrically coupled to a drain terminal (or a first terminal) of the second switch YscL. Furthermore, a source terminal (or a second terminal) of the second switch YscL is electrically coupled to the VscL voltage source. Here, the first switch Yfr is turned on during the address period AP in which the VscL voltage is applied to the Y electrode as well as the falling period of the reset period RP in which the Vnf voltage is applied to the Y electrode and allows a bias current to flow to the second switch YscL. Furthermore, a voltage which is the same as a certain voltage difference (ΔV of FIG. 2) between the Vnf voltage of the falling reset signal applied to the Y electrode during the falling period of the reset period RP and the VscL voltage of the scan low signal applied to the Y electrode during the address period AP is applied between the drain terminal and the source terminal of the second switch YscL during the falling period of the reset period RP. Hence, the second switch YscL provides a similar function as a diode having a large electric power that was previously used for providing a certain voltage difference (ΔV of FIG. 2) between the Vnf voltage of the falling reset signal applied to the Y electrode during the falling period of the reset period RP and the VscL voltage of the scan low signal applied to the Y electrode during the address period AP. As described above, because the first switch Yfr and the second switch YscL are coupled in series and a bias current flows to the second switch YscL through the first switch Yfr during the address period AP, it is possible to use a switch having a low withstanding voltage that can withstand a certain voltage difference (i.e., ΔV; approximately 25V) between the Vnf voltage and the VscL voltage as the second switch YscL. Hence, according to the described embodiment of the present invention, it is possible to use a switch having a low withstanding voltage as the second switch YscL, and thus it is possible to reduce the manufacturing cost as compared to using a switch having a high withstanding voltage.

In the first driving IC 442, an input part includes a control signal input terminal IN and a ground terminal GND1 that make a pair, and an output part includes an output terminal OUT and a ground terminal GND2. The output terminal OUT of the first driving IC 442 is electrically coupled to a control terminal (also referred to as a gate terminal) of the first switch Yfr, and the ground terminal GND2 of the first driving IC 442 is electrically coupled to a second node N2 between the first switch Yfr and the second switch YscL, which is, to the source terminal of the first switch Yfr. When a control signal IN_Yfr for controlling the first switch Yfr, for example, a control signal having a high level, is inputted to the control signal input terminal IN of the first driving IC 442, the first driving IC 442 applies an operation voltage Vcc, which is a voltage difference between the output terminal OUT and the ground terminal GND2, to the first switch Yfr and turns on the first switch Yfr. Here, the operation voltage Vcc is higher than a threshold voltage of the first switch Yfr for turning on the first switch Yfr and may be 15 volts when a threshold voltage of the first switch Yfr is 5 volts, for example.

Similarly to the first driving IC 442, in the second driving IC 444, an input part includes a control signal input terminal IN and a ground terminal GND1 that make a pair, and an output part includes an output terminal OUT and a ground terminal GND2. The output terminal OUT of the second driving IC 444 is electrically coupled to a control terminal (also referred to as a gate terminal) of the second switch YscL, and the ground terminal GND2 of the second driving IC 444 is electrically coupled to a third node N3 between the second switch YscL and the VscL voltage source, which is, to the source terminal of the second switch YscL. When a control signal IN_YscL for controlling the second switch YscL, for example, a control signal having a high level, is inputted to the control signal input terminal IN of the second driving IC 444, the second driving IC 444 applies an operation voltage Vcc, which is a voltage difference between the output terminal OUT and the ground terminal GND2, to the second switch YscL and turns on the second switch YscL. Here, the operation voltage Vcc is higher than a threshold voltage of the second switch YscL for turning on the second switch YscL and may be 15 volts when a threshold voltage of the second switch YscL is 5 volts, for example.

The control Zener diode ZDc is electrically coupled between the gate terminal of the first switch Yfr and the gate terminal of the second switch YscL. Furthermore, a cathode of the control Zener diode ZDc is electrically coupled between the output terminal OUT of the first driving IC 442 and the gate terminal of the first switch Yfr, and an anode of the control Zener diode ZDc is electrically coupled to the gate terminal of the second switch YscL. When the current flows to the gate terminal of the second switch YscL through the control Zener diode ZDc and a voltage between a gate and a source of the second switch YscL becomes a threshold voltage of the second switch YscL, the second switch YscL is turned on. Here, because the control Zener diode ZDc is coupled between the gate terminal of the first switch Yfr and the gate terminal of the second switch YscL, the current that can control the switching of the second switch YscL flows through the control Zener diode ZDc. Hence, it is possible to use a Zener diode having a low electric power, for example, 500 mW, as the control Zener diode ZDc. Therefore, according to the described embodiment of the present invention, it is possible to reduce the manufacturing cost by using the control Zener diode ZDc having a low electric power.

The control resistor Rc is electrically coupled between the control terminal of the second switch YscL and the VscL voltage source. Furthermore, the control resistor Rc is electrically coupled between the anode of the control Zener diode ZDc and the ground terminal GND2 of the second driving IC 444. When the current passed through the control Zener diode ZDc is discharged through the control resistor Rc, the second switch YscL is turned off. As described above, the control resistor Rc and the control Zener diode ZDc are used to adjust a gate voltage of the second switch YscL by enabling the current flowing to the gate terminal of the second switch YscL to be controlled.

The ramp generating circuit 446 sets an inclination (or slope) of the falling reset signal applied to the Y electrode during the falling period of the reset period RP. The ramp generating circuit 446 includes a first terminal electrically coupled to a first node N1 between the Y electrode and the drain terminal of the first switch Yfr, a second terminal coupled to the gate terminal of the first switch Yfr, and a third terminal electrically coupled to the output terminal OUT of the first driving IC 442 and the cathode of the control Zener diode ZDc.

Furthermore, the falling reset signal/scan low signal generating circuit 440 in one embodiment further includes the diode D1 that has an anode electrically coupled to the gate terminal of the first switch Yfr and the second terminal of the ramp generating circuit 446 and a cathode electrically coupled to the cathode of the control Zener diode ZDc and the third terminal of the ramp generating circuit 446. The diode D1 prevents the current from flowing in the reverse direction when the current flows in the direction of the second switch YscL through the control Zener diode ZDc.

Furthermore, the falling reset signal/scan low signal generating circuit 440 should maintain a high impedance state before the second driving IC 444 performs an operation of completely turning on the second switch YscL. Hence, if the second driving IC 444 is not an IC for high impedance, then the falling reset signal/scan low signal generating circuit 440 can have the diode Dhi for high impedance electrically coupled between the output terminal OUT of the second driving IC 444 and the control Zener diode ZDc or a switch for high impedance (for example, a PNP bipolar transistor Thi of FIG. 4).

The scan high signal generating circuit 450 includes a capacitor CscH and a diode DscH and applies a VscH voltage to the Y electrode of a light emitting cell that is not to be turned on in the address period AP.

The selection circuit 460 includes switches Sch and Scl. Generally, the selection circuit 460 is coupled to the respective Y electrodes Y1 to Yn in the form of an IC so as to sequentially select a plurality of Y electrodes Y1 to Yn in the address period AP, and a driving circuit of the scan driver 400 is coupled to the Y electrodes Y1 to Yn through the respective selection circuits 460. In FIG. 3, there is illustrated only the selection circuit 460 coupled to one Y electrode.

A source terminal of the switch Sch and a drain terminal of the switch Scl are coupled to the Y electrode of the panel capacitor Cp. A first terminal of the capacitor CscH is coupled to the contact point between a source terminal of the switch Scl and the drain terminal of the first switch Yfr, and the drain terminal of the switch Sch is coupled to a second terminal of the capacitor CscH. Furthermore, a cathode of the diode DscH that has an anode coupled to a VscH voltage source for supplying a VscH voltage is coupled to the drain terminal of the switch Sch.

In the meantime, each switch Ys, Yg, Yr, Yf, Yrr, YscL, Sch, Scl, Ypp and Ypn is illustrated as one switch in FIG. 3, but each switch Ys, Yg, Yr, Yf, Yrr, YscL, Sch, Scl, Ypp and Ypn can be formed by one switch or a plurality of switches that are coupled together (e.g., coupled in parallel).

Figure 4:
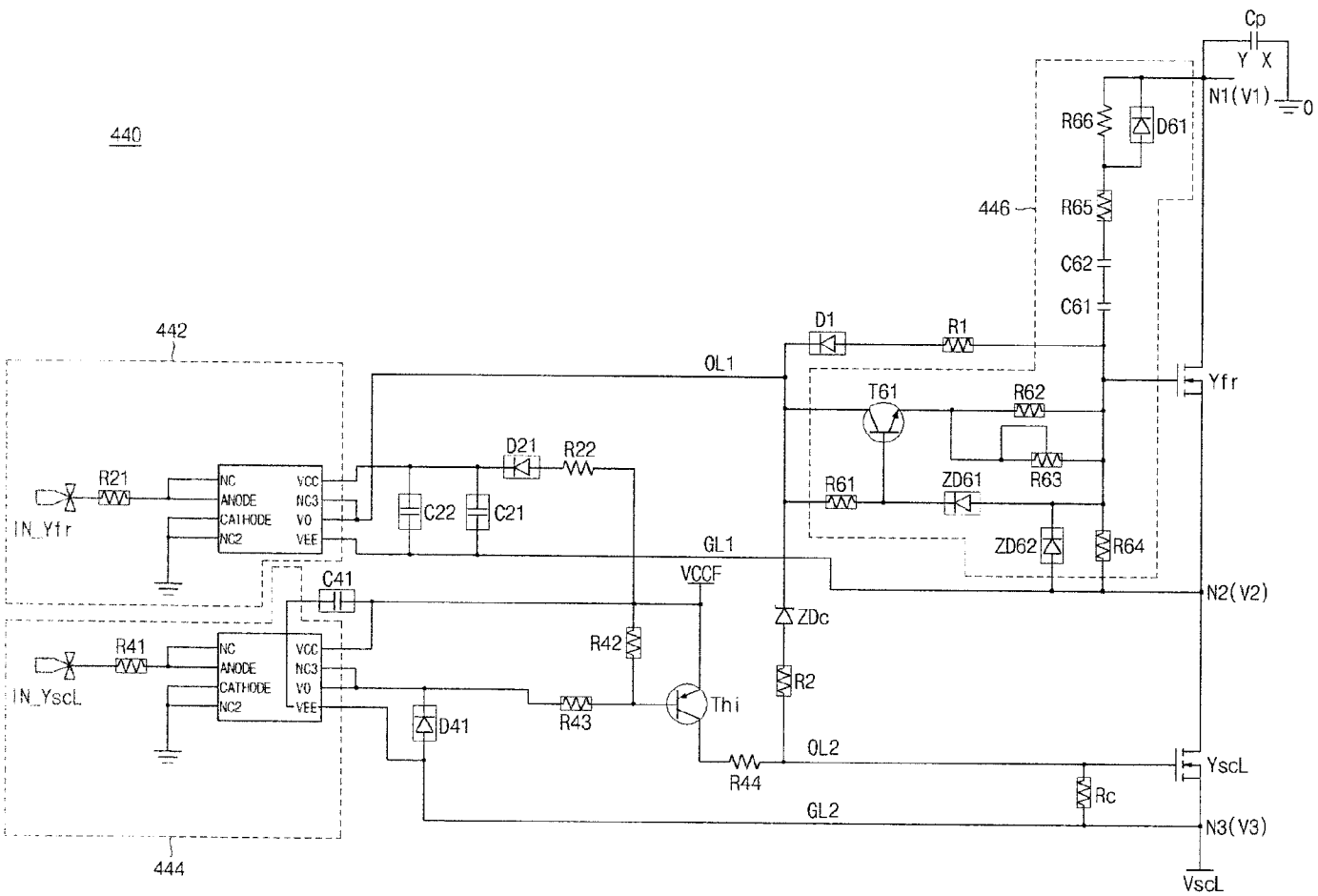
FIG. 4 is a detailed circuit diagram of a falling reset signal/scan low signal generating circuit of the scan driver of FIG. 3.

FIG. 4 is a detailed circuit diagram of the falling reset signal/scan low signal generating circuit 440 of the scan driver illustrated in FIG. 3.

The falling reset signal/scan low signal generating circuit 440 illustrated in FIG. 4 is an example only. The structure of the falling reset signal/scan low signal generating circuit 440 can be different in other embodiments.

As illustrated in FIG. 4, because the first switch Yfr and the second switch YscL have been described in FIG. 3, the description thereof will be omitted.

In the first driving IC 442, an input part includes control signal input terminals ANODE (corresponding to the IN of FIG. 3) that make a pair with a ground terminal CATHODE (corresponding to the GND1 of FIG. 3). Here, a control signal IN_Yfr for controlling the first switch Yfr is inputted to the control signal input terminal ANODE of the first driving IC 442, and the ground terminal CATHODE is grounded.

Furthermore, in the first driving IC 442, an output terminal includes a high voltage terminal VCC, a low voltage terminal VEE (corresponding to the GND2 of FIG. 3) and a voltage output terminal VO (corresponding to the OUT of FIG. 3). Here, the high voltage terminal VCC is coupled to an external voltage source VCCF that provides an operation voltage Vcc for turning on the first switch Yfr, and the low voltage terminal VEE is coupled to the source terminal of the first switch Yfr through a first ground line GL1, and the voltage output terminal VO is coupled to the gate terminal of the first switch Yfr through a first output line OL1.

This first driving IC 442 may be an opto-coupler (for example, HCPL-0314 available from Hewlett-Packard Company), but the first driving IC 442 is not limited to the opto-coupler. Here, the operation voltage Vcc provided by the external voltage source VCCF is higher than a threshold voltage of the first switch Yfr to turn on the first switch Yfr, and the HCPL-0314 available from Hewlett-Packard Company can provide 10 volts to 30 volts as the operation voltage Vcc.

Furthermore, the falling reset signal/scan low signal generating circuit 440 illustrated in FIG. 2 further includes a resistor R21 coupled to a path along which the control signal IN_Yfr for controlling the first switch Yfr is inputted to the control signal input terminal ANODE of the first driving IC 442.

Moreover, in order to form a current path from the external voltage source VCCF to the first driving IC 442, the falling reset signal/scan low signal generating circuit 440 in the embodiment of FIG. 4 further includes a resistor R22 coupled to the external voltage source VCCF, and a diode D21 that has an anode coupled to the resistor R22 and a cathode coupled to the high voltage terminal VCC of the first driving IC 442.

In addition, the falling reset signal/scan low signal generating circuit 440 of FIG. 4 further includes a capacitor C21, which is coupled between the high voltage terminal VCC and the low voltage terminal VEE of the first driving IC 442 so as to cut off the noise, and a capacitor C22, which is coupled between the high voltage terminal VCC and the low voltage terminal VEE of the first driving IC 442, so as to charge the operation voltage Vcc from the external voltage source VCCF. The operation voltage Vcc charged in the capacitor C22, which is coupled between the high voltage terminal VCC and the low voltage terminal VEE of the first driving IC 442, is applied to the first switch Yfr through the voltage output terminal VO of the first driving IC 442 and enables the first switch Yfr to be turned on.

Similarly to the first driving IC 442, in the second driving IC 444, an input part includes control signal input terminals ANODE (corresponding to the IN of FIG. 3) that make a pair with a ground terminal CATHODE (corresponding to the GND1 of FIG. 3). Here, a control signal IN_YscL for controlling the second switch YscL is inputted to the control signal input terminal ANODE of the second driving IC 444, and the ground terminal CATHODE is grounded.

Similarly to the first driving IC 442, in the second driving IC 444, an output terminal includes a high voltage terminal VCC, a low voltage terminal VEE (corresponding to the GND2 of FIG. 3) and a voltage output terminal VO (corresponding to the OUT of FIG. 3). Here, the high voltage terminal VCC is coupled to an external voltage source VCCF that provides an operation voltage Vcc for turning on the second switch YscL, and the low voltage terminal VEE is coupled to the source terminal of the second switch YscL through a second ground line GL2, and the voltage output terminal VO is coupled to the gate terminal of the second switch YscL through a second output line OL2.

Similarly to the first driving IC 442, such second driving IC 444 may be an opto-coupler (for example, HCPL-0314 available from Hewlett-Packard Company), but the second driving IC 444 is not limited to the opto-coupler. Here, the operation voltage Vcc provided by the external voltage source VCCF is higher than a threshold voltage of the second switch YscL to turn on the second switch YscL, and the HCPL-0314 available from Hewlett-Packard Company can provide 10 volts to 30 volts as the operation voltage Vcc.

Furthermore, the falling reset signal/scan low signal generating circuit 440 of FIG. 4 further includes a resistor R41 coupled to a path along which the control signal IN_YscL for controlling the second switch YscL is inputted to the control signal input terminal ANODE of the second driving IC 444.

Moreover, the falling reset signal/scan low signal generating circuit 440 of FIG. 4 further includes a capacitor C41, which is coupled between the high voltage terminal VCC and the low voltage terminal VEE of the second driving IC 444, so as to charge the operation voltage Vcc from the external voltage source VCCF. The operation voltage Vcc charged in the capacitor C41 between the high voltage terminal VCC and the low voltage terminal VEE of the second driving IC 444 is applied to the second switch YscL through the voltage output terminal VO of the second driving IC 444 and enables the second switch YscL to be turned on.

In addition, the falling reset signal/scan low signal generating circuit 440 of FIG. 4 further includes a switch for high impedance, for example, a PNP bipolar transistor Thi which is coupled between the voltage output terminal VO of the second driving IC 444 and the gate terminal of the second switch YscL so as to set a high impedance state of the second driving IC 444. The PNP bipolar transistor Thi includes a base terminal which is coupled to the voltage output terminal VO of the second driving IC 444, an emitter terminal which is coupled to the external voltage source VCCF, and a collector terminal which is coupled to the gate terminal of the second switch YscL. Here, the PNP bipolar transistor Thi is included to set a high impedance state of the second driving IC 444, but it can be substituted by a diode Dhi for high impedance as shown in FIG. 3.

Furthermore, the falling reset signal/scan low signal generating circuit 440 of FIG. 4 further includes a resistor R42 which is coupled between a current path for coupling the external voltage source VCCF with the high voltage terminal VCC of the second driving IC 444 and the base terminal of the PNP bipolar transistor Thi, a resistor R43 which is coupled between the voltage output terminal VO of the second driving IC 444 and the base terminal of the PNP bipolar transistor Thi, and a resistor R44 which is coupled between the collector terminal of the PNP bipolar transistor Thi and the second switch YscL. A diode D41 is coupled between the voltage output terminal VO of the second driving IC 444 and the third node N3.

The ramp generating circuit 446 sets an inclination (or a slope) of a falling reset waveform applied to the Y electrode during a falling period of the reset period RP. This ramp generating circuit 446 includes a switch, for example, an NPN bipolar transistor T61, coupled between the voltage output line VO of the first driving IC 442 and the first switch Yfr, a resistor R61 coupled between a current path for coupling a collector of the NPN bipolar transistor T61 with the voltage output terminal VO of the first driving IC 442 and the base terminal of the NPN bipolar transistor T61, resistors R62 and R63, which are coupled in parallel between the emitter terminal of the NPN bipolar transistor T61 and the gate terminal of the first switch Yfr, a Zener diode ZD61 which is coupled between the base terminal of the NPN bipolar transistor T61 and the gate terminal of the first switch Yfr, and a Zener diode ZD62 and a resistor R64, which are coupled in parallel between the Zener diode ZD61 and the source terminal of the first switch Yfr.

Furthermore, the ramp generating circuit 446 of FIG. 4 further includes resistors R65 and R66 electrically coupled to the drain terminal of the first switch Yfr, capacitors C61 and C62 electrically coupled between the resistors R65 and R66 and the gate terminal of the first switch Yfr, and a diode D61 coupled in parallel with the resistor R66 between the drain terminal of the first switch Yfr and the resistor R65.

Because the control Zener diode ZDc, the control resistor Rc and the diode D1 have been described in FIG. 3, the description thereof will be omitted.

The falling reset signal/scan low signal generating circuit 440 of FIG. 4 further includes a resistor R1 electrically coupled between the voltage output terminal VO of the first driving IC 442 and the first switch Yfr, and a resistor R2 electrically coupled between the control Zener diode ZDc and the control resistor Rc.

Hereinafter, the operation of the falling reset signal/scan low signal generating circuit 440 that applies a falling reset signal to the Y electrode during a falling period of the reset period RP and applies a scan low signal to the Y electrode during the address period AP will be described with reference to FIGS. 5 and 6*a* to 6*e*.

Figure 5:
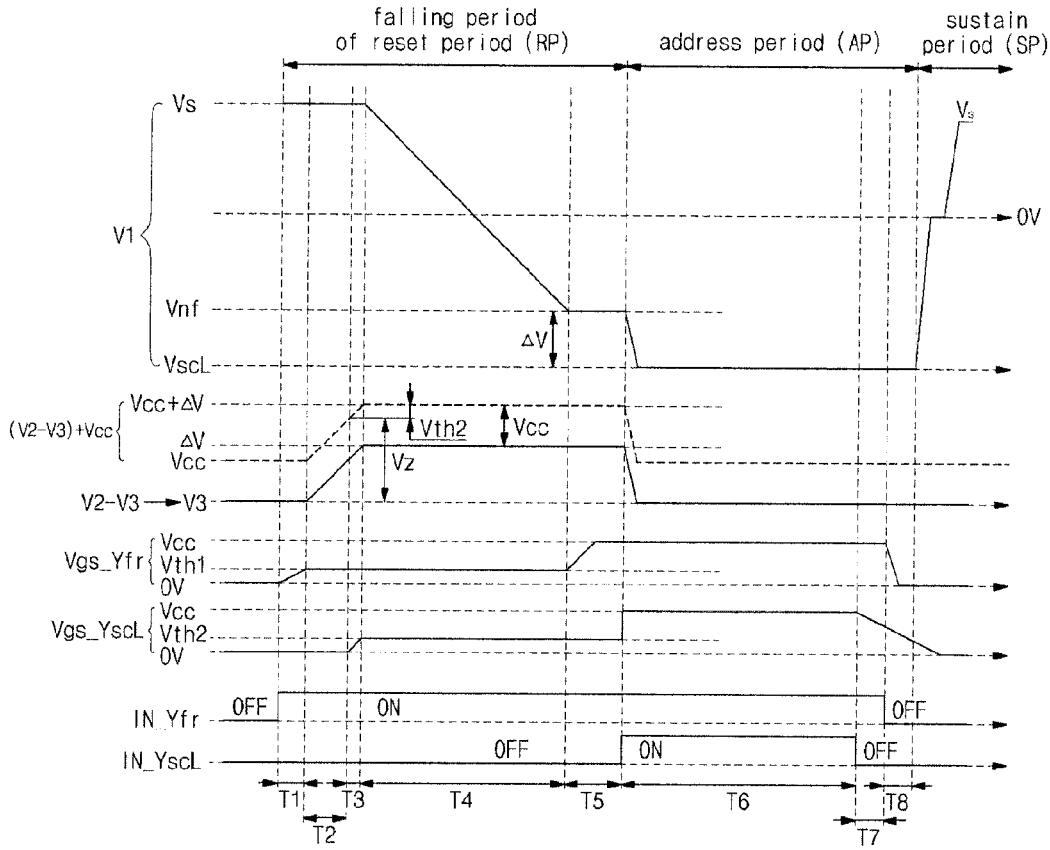
FIG. 5 is a view of an operation timing of the falling reset signal/scan low signal generating circuit illustrated in FIG. 3 during a falling period of a reset period and an address period.

FIG. 5 is a view of an operation timing of the falling reset signal/scan low signal generating circuit 440 illustrated in FIG. 3 during a falling period of the reset period and the address period AP, and FIGS. 6*a* to 6*e* are views of a current path in accordance with an operation of the falling reset signal/scan low signal generating circuit 440 illustrated in FIG. 3 during a falling period of the reset period RP and the address period AP.

Firstly, it is assumed that the switch Scl is turned on and the main control switch Ypn is turned off after a Vs voltage is applied to the panel capacitor Cp. Hence, a voltage V1 of the first node N1 to which the drain terminal of the first switch Yfr is coupled becomes the Vs voltage. In other words, a voltage of the drain terminal of the first switch Yfr becomes the Vs voltage. Here, a voltage of the second node N2 at which the ground line GL1 of the first driving IC 442 is coupled to the first switch Yfr and the second switch YscL is referred to as V2, and a voltage of the third node N3 at which the ground line GL2 of the second driving IC 444 is coupled to the second switch YscL and the VscL voltage source is referred to as V3.

In a driving method of a plasma display device according to an embodiment of the present invention, a method of applying a falling reset signal to the Y electrode during a falling period of the reset period RP and applying a scan low signal to the Y electrode during the address period AP includes a first step of turning on the first switch Yfr electrically coupled between the Y electrode and the VscL voltage source, a second step of repeating the turn-on and turn-off actions of the second switch YscL coupled in series between the first switch Yfr and the VscL voltage source to apply a falling reset signal which is decreased from the Vs voltage to the Vnf voltage to the Y electrode, and a third step of turning on the second switch YscL to apply a scan low signal having a scan low voltage to the Y electrode.

Figure 6A:
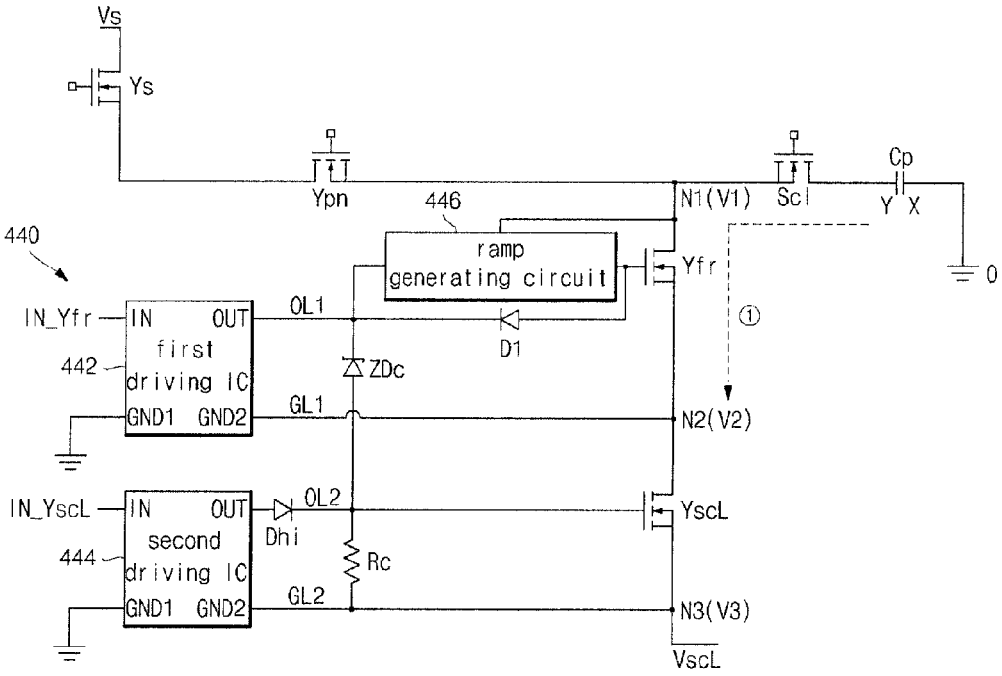
FIGS. 6*a* to 6*e* are views of a current path in accordance with an operation of the falling reset signal/scan low signal generating circuit illustrated in FIG. 3 during a falling period of a reset period and an address period.

As illustrated in FIG. 5, in section (or period) T1, when the control signal IN_Yfr having a high level is applied to the control signal input terminal IN of the first driving IC 442, the operation voltage Vcc, which is a voltage difference between the output terminal OUT and the ground terminal GND2 of the first driving IC 442, is applied to the first switch Yfr. Hence, when a voltage Vgs_Yfr between a gate and a source of the first switch Yfr increases and reaches a threshold voltage Vth1 of the first switch Yfr, the first switch Yfr is turned on. Then, as illustrated in FIG. 6*a*, a current flows from the first node N1 to the second node N2 ①. At this time, the output of the second driving IC 444 is in a high impedance state.

In section (or period) T2, as long as the first switch Yfr is turned on and the following Equation 1 is satisfied, the voltage V2 of the second node N2 is increased, and a voltage between a drain and a source of the first switch Yfr is decreased in such a state that the voltage V1 of the first node N1 almost does not drop. This phenomenon occurs because a capacitance between a drain and a source of the second switch YscL is very small compared with a load of the panel capacitor Cp. Here, because the output of the second driving IC 444 is in a high impedance state, a voltage Vgs_YscL between a gate and a source of the second switch YscL continuously maintains 0V by the control resistor Rc.

$$(V2-V3)+Vcc<Vz \quad \text{Equation 1}$$

Here, V2−V3 is a voltage between the drain terminal and the source terminal of the second switch YscL, and Vcc is an operation voltage for driving the first switch Yfr and is higher than a threshold voltage Vth1 of the first switch Yfr, and Vz is a voltage between the ends of the control Zener diode ZDc.

Figure 6B:
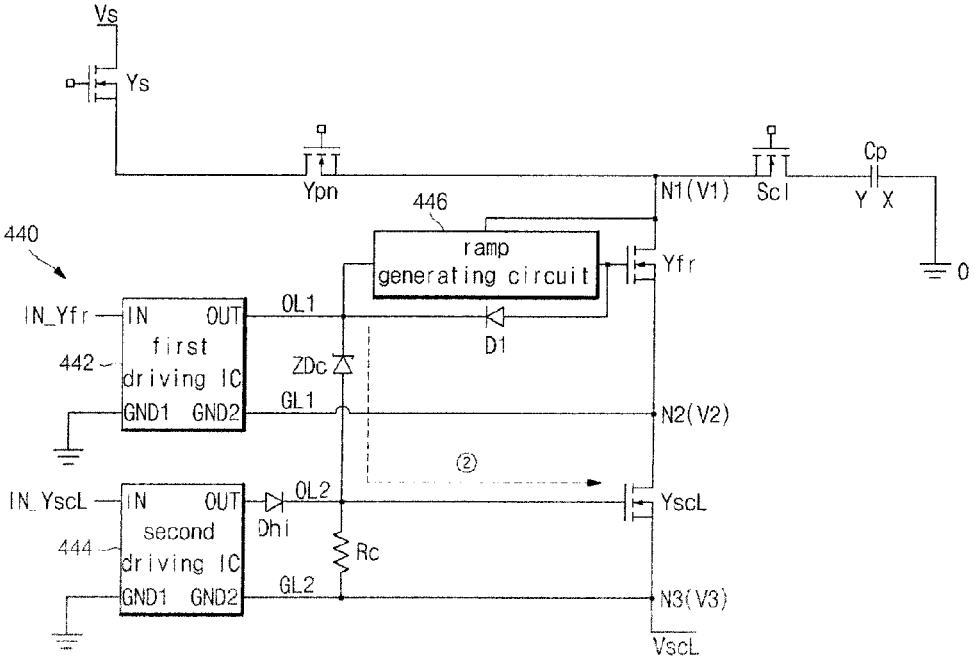

In section (or period) T3, when the voltage V2 of the second node N2 increases and satisfies the following Equation 2, a current flows to the gate terminal of the second switch YscL through the control Zener diode ZDc as illustrated in FIG. 6*b*, and a voltage Vgs_YscL between a gate and a source of the second switch YscL starts to increase ②.

$$(V2-V3)+Vcc>Vz \quad \text{Equation 2}$$

Furthermore, if a voltage Vgs_YscL between a gate and a source of the second switch YscL is continuously increased, then the result shown in the following Equation 3 is attained. Here, Vth2 is a threshold voltage of the second switch YscL.

$$(V2-V3)+Vcc=Vz+Vth2 \quad \text{Equation 3}$$

Figure 6C:
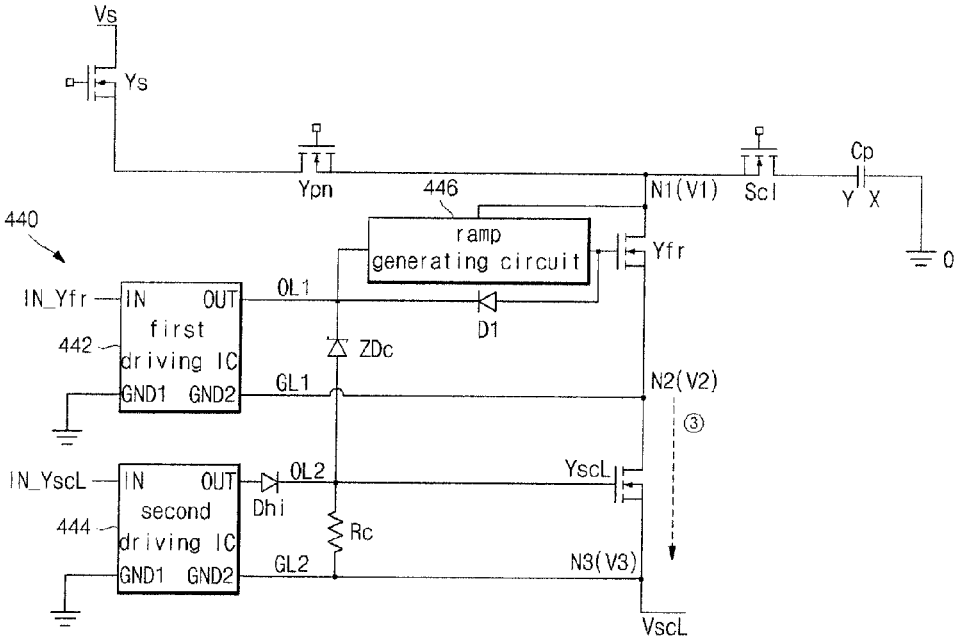
Figure 6D:
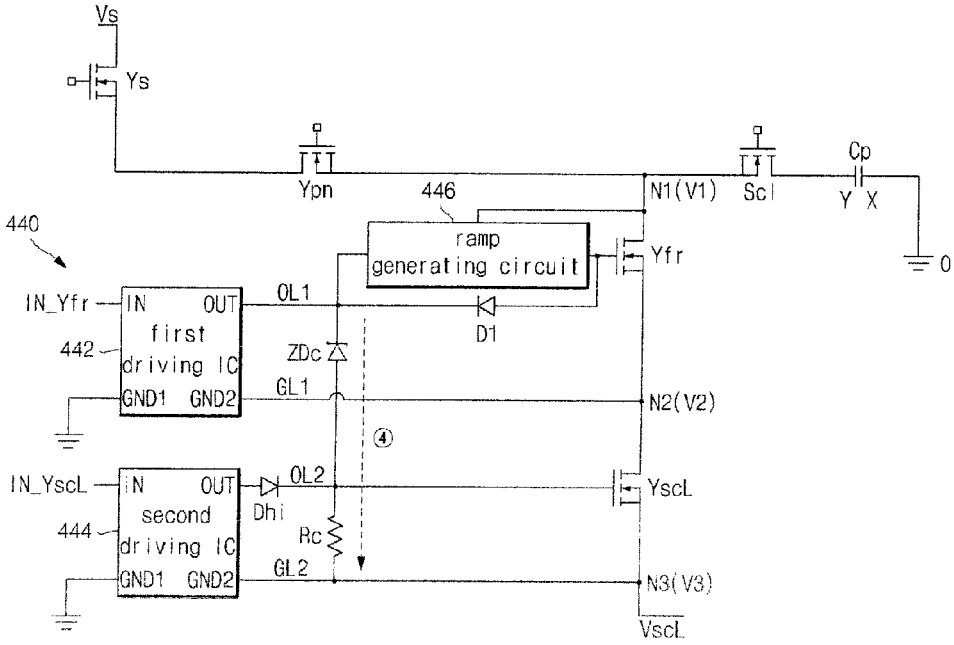

In section (or period) T4, if a current entered from the first node N1 to the second node N2 increases the voltage V2 of the second node N2 while the first switch Yfr is turned on, then a voltage Vgs_YscL between a gate and a source of the second switch YscL is increased above a threshold voltage Vth2 of the second switch YscL by the following Equation 4. Hence, as illustrated in FIG. 6*c*, the second switch YscL is turned on, and a current flows from the second node N2 to the third node N3, and the voltage V2 of the second node N2 is decreased ③. As described above, if the voltage V2 of the second node N2 is decreased, then a current does not flow through the control Zener diode ZDc, so that a current flows through the control resistor Rc as illustrated in FIG. 6*d*, and a voltage Vgs_YscL between a gate and a source of the second switch YscL is decreased ④. Hence, the second switch YscL is turned off. If the second switch YscL is turned off, then the voltage V2 of the second node N2 is increased by a current entered through the first switch Yfr. Then, the following Equation 4 is satisfied again, and thus the second switch YscL is turned on again.

$$Vgs_YscL=(V2-V3)+Vcc-Vz \quad \text{Equation 4}$$

The aforementioned operations are repeated, and thus the result shown in the following Equation 5 is maintained all through section T4. That is, V2=V3+ΔV is maintained, and the voltage V1 of the first node N1 is continuously decreased, and thus the shape of a falling reset signal is made.

$$(V2-V3)=Vz+Vth2-Vcc=\Delta V \quad \text{Equation 5}$$

Here, ΔV is defined as a certain voltage difference (ΔV of FIG. 2) between the Vnf voltage of a falling reset signal applied to the Y electrode during a falling period of the reset period RP and the VscL voltage of a scan low signal applied to the Y electrode during the address period AP and is the same as a voltage V2−V3 between the drain terminal and the source terminal of the second switch YscL. This voltage V2−V3 between the drain terminal and the source terminal of the second switch YscL is a voltage which is produced by subtracting the operation voltage Vcc of the first driving IC 442 from the voltage Vz between the ends of the control Zener diode ZDc added to the threshold voltage Vth2 of the second switch YscL and can be adjusted by the voltage Vz between the ends of the control Zener diode ZDc, the threshold voltage Vth2 of the second switch YscL and the operation voltage Vcc outputted from the first driving IC 442. For example, when ΔV is set to 25 volts, a circuit in which the control Zener diode ZDc having 35 volts, the second switch YscL having the threshold voltage Vth2 of 5 volts and the first driving IC 442 having the operation voltage Vcc of 15 volts are arranged can be provided.

In section (or period) T5, if the voltage V1 of the first node N1 is finally the same as the voltage V2 of the second node N2, then the result shown in the following Equation 6 is attained.

$$V1=V2-V3=\Delta V \quad \text{Equation 6}$$

Furthermore, the voltage Vgs_Yfr between a gate and a source of the first switch Yfr is gradually increased and becomes the operation voltage Vcc, so that the first switch Yfr is completely turned on, and the voltage Vgs_YscL between a gate and a source of the second switch YscL is maintained in a slightly turned-off state by the control resistor Rc in a state of the threshold voltage Vth2 of the second switch YscL.

Figure 6E:
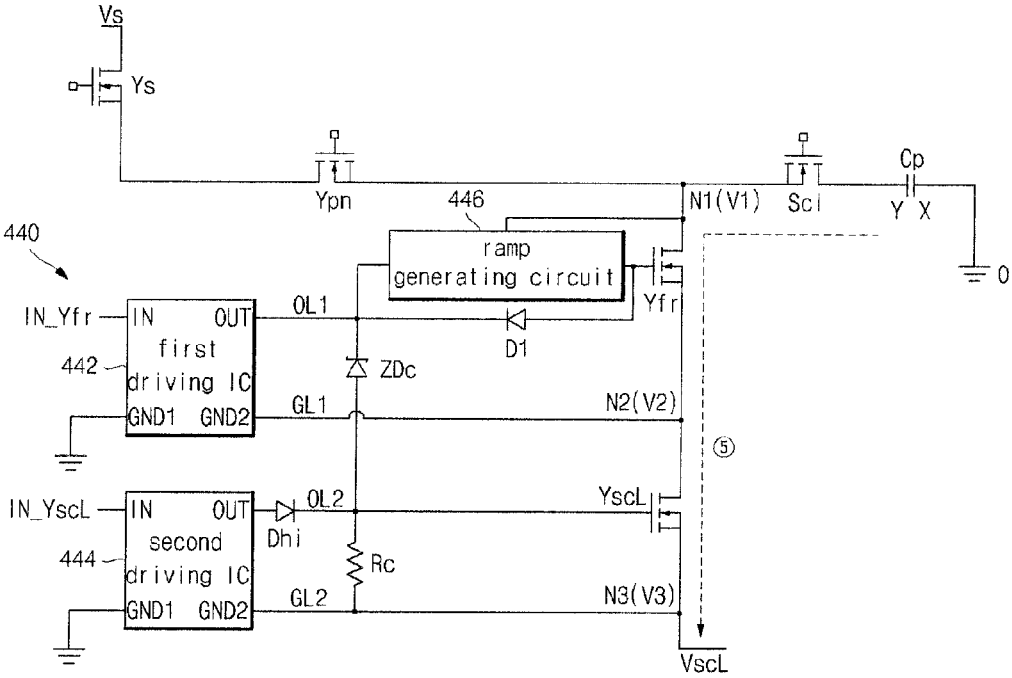

In section (or period) T6, when the control signal IN_YscL having a high level is applied to the control signal input terminal IN of the second driving IC 444, the output of the second driving IC 444 leaves a high impedance state, and the operation voltage Vcc which is a voltage difference between the output terminal VO and the ground terminal GND2 of the second driving IC 444 is applied to the second switch YscL. Hence, the voltage Vgs_YscL between a gate and a source of the second switch YscL increases and becomes the operation voltage Vcc above the threshold voltage Vth2 of the second switch YscL, so that the second switch YscL is completely turned on, and the second node N2 is coupled to the third node N3 as illustrated in FIG. 6*e* ⑤. Furthermore, because the first switch Yfr is in a completely turned-on state, the voltage V1 of the first node N1 becomes the voltage V3 of the third node, which is the VscL voltage. Hence, when an address signal having the Va voltage is applied to the A electrode during the address period AP and an address discharge is carried out, the voltage V1 of the first node N1 can be maintained at VscL voltage without disturbance in such a state that the first switch Yfr and the second switch YscL are tuned on. Because the voltage V1 of the first node N1 is maintained at the VscL voltage without disturbance by the first switch Yfr and the second switch YscL during the address period AP, less stress is applied to each of the first switch Yfr and the second switch YscL. Furthermore, because the first switch Yfr serves to allow a bias current to flow to the second switch YscL while the VscL voltage is applied to the Y electrode of a cell to be turned on during the address period AP, the second switch YscL has a low withstanding voltage (approximately 25 volts) of a Vnf−VscL.

In section (or period) T7, if the control input signal IN_YscL of the second switch YscL is not inputted, then the output of the second driving IC 444 is in a high impedance state, and the voltage Vgs_YscL between a gate and a source of the second switch YscL is slowly decreased.

In section (or period) T8, if the control input signal IN_Yfr of the first switch Yfr is not inputted, then the first switch Yfr is completely turned off.

After section T8, when the main control switches Ypp and Ypn and the switch Scl of the selection circuit 460 are turned on, the sustain period SP begins.

As described above, the falling reset signal/scan low signal generating circuit 440 of a plasma display device according to an embodiment of the present invention couples the first switch Yfr and the second switch YscL between the Y electrode and the VscL voltage source in series and has the control Zener diode ZDc and the control resistor Rc for controlling a gate voltage of the second switch YscL, so that it enables the first switch Yfr to control a bias current to flow to the second switch YscL even during the address period AP. Hence, the second switch YscL positioned between the first switch Yfr and the VscL voltage source has a low withstanding voltage (approximately 25 volts) of a Vnf−VscL. Accordingly, because the falling reset signal/scan low signal generating circuit 440 of a plasma display device according to an embodiment of the present invention can use a switch having a low withstanding voltage as the second switch Yscl, it is possible to reduce the manufacturing cost of a plasma display device.

Furthermore, the falling reset signal/scan low signal generating circuit 440 of a plasma display device according to an embodiment of the present invention can use a Zener diode having a low electric power as the control Zener diode ZDc which is coupled between the gate terminal of the first switch Yfr and the gate terminal of the second switch YscL. Hence, the falling reset signal/scan low signal generating circuit 440 of a plasma display device according to an embodiment of the present invention can reduce the manufacturing cost of a plasma display device.

Figure 7:
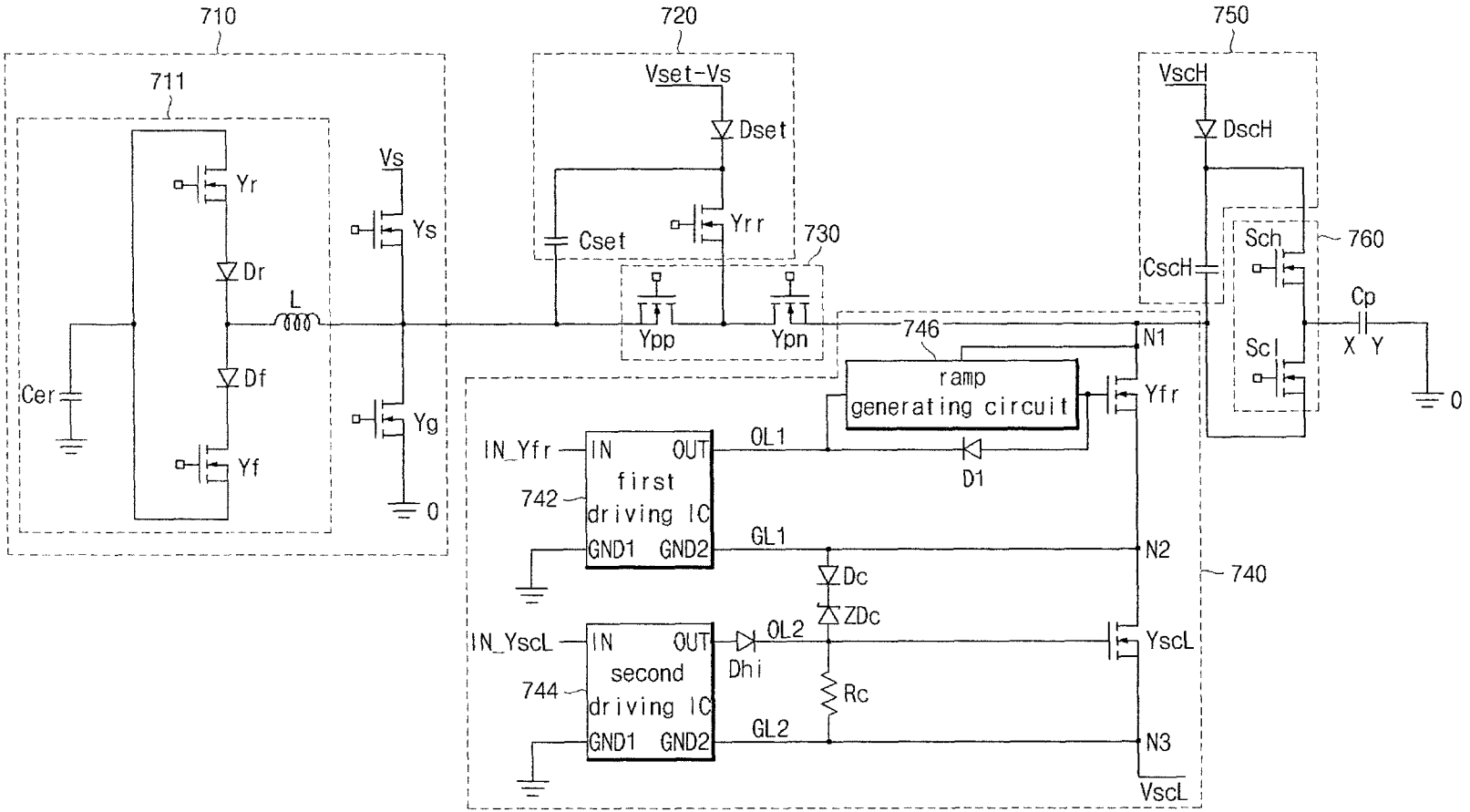
FIG. 7 is a circuit diagram of a scan driver of a plasma display device according to another embodiment of the present invention.

FIG. 7 is a circuit diagram of a scan driver of a plasma display device according to another embodiment of the present invention.

A plasma display device according to another embodiment of the present invention includes a plasma display panel 100, a controller 200, an address driver 300, a scan driver 700 and a sustain driver 500.

Because the plasma display panel 100, the controller 200, the address driver 300 and the sustain driver 500 of a plasma display device according to another embodiment of the present invention are substantially the same as those of a plasma display device according to an embodiment of the present invention, identical reference numerals are designated to them, and the description thereof will be omitted. Hence, only the scan driver 700 of a plasma display device according to another embodiment of the present invention will be described hereinafter.

As illustrated in FIG. 7, the scan driver 700 of a plasma display device according to another embodiment of the present invention includes a sustain signal generating circuit 710 including an energy recovery circuit 711, a rising reset signal generating circuit 720, a switching circuit 730, a falling reset signal/scan low signal generating circuit 740, a scan high signal generating circuit 750 and a selection circuit 760.

Because the sustain signal generating circuit 710, the rising reset signal generating circuit 720, the switching circuit 730, the scan high signal generating circuit 750 and the selection circuit 760 of a plasma display device according to another embodiment of the present invention are substantially the same as the sustain signal generating circuit 410, the rising reset signal generating circuit 420, the switching circuit 430, the scan high signal generating circuit 450 and the selection circuit 460 of the scan driver 400 of a plasma display device according to an embodiment of the present invention, the description thereof will be omitted.

The falling reset signal/scan low signal generating circuit 740 includes a first switch Yfr, a second switch YscL, a VscL voltage source (a scan low voltage source), a first driving IC 742, a second driving IC 744, a ramp generating circuit 746, a control Zener diode ZDc, a control resistor Rc and a diode Dc for preventing a countercurrent. Furthermore, the falling reset signal/scan low signal generating circuit 740 can further include a diode D1 and a diode Dhi for high impedance. This falling reset signal/scan low signal generating circuit 740 applies a falling reset signal, which is gradually decreased from a Vs voltage (or a first voltage) to a Vnf voltage (or a second voltage), to the Y electrode during a falling period of the reset period RP and applies a scan low signal having a VscL voltage to the Y electrode of a discharge cell to be turned on during the address period AP.

Compared with the falling reset signal/scan low signal generating circuit 440 illustrated in FIG. 3, the falling reset signal/scan low signal generating circuit 740 is different only in that the control Zener diode ZDc is coupled to a source terminal of the first switch Yfr and a gate terminal of the second switch YscL, and the diode Dc for preventing a countercurrent is added. Hence, the description about a connection configuration of the control Zener diode ZDc and an operation of the falling reset signal/scan low signal generating circuit 740 due to the variation of a connection configuration of the control Zener diode ZDc will be mainly made.

Because the first switch Yfr, the second switch YscL, the first driving IC 742, the second driving IC 744, the ramp generating circuit 746, the control resistor Rc, the diode D1 and the diode Dhi for high impedance are the same as the first switch Yfr, the second switch YscL, the first driving IC 442, the second driving IC 444, the ramp generating circuit 446, the control resistor Rc, the diode D1 and the diode Dhi for high impedance illustrated in FIG. 3, the description thereabout will be omitted.

The control Zener diode ZDc is coupled between a source terminal of the first switch Yfr and a gate terminal of the second switch YscL. Furthermore, a cathode of the control Zener diode ZDc is electrically coupled between the source terminal of the first switch Yfr and a ground terminal GND2 of the first driving IC 742, and an anode of the control Zener diode ZDc is electrically coupled between the gate terminal of the second switch YscL and the control resistor Rc. When the current flows to the gate terminal of the second switch YscL through the control Zener diode ZDc and a voltage between a gate and a source of the second switch YscL becomes a threshold voltage of the second switch YscL, the second switch YscL is turned on. Here, because the control Zener diode ZDc is coupled between the source terminal of the first switch Yfr and the gate terminal of the second switch YscL, the current that can control the switching of the second switch YscL flows through the control Zener diode ZDc. Hence, it is possible to use a Zener diode having a low electric power, for example, 500 mW as the control Zener diode ZDc. Therefore, according to the described embodiment of the present invention, it is possible to reduce the manufacturing cost by using the control Zener diode ZDc having a low electric power.

The diode Dc for preventing a countercurrent is coupled between the source terminal of the first switch Yfr and the control Zener diode ZDc. Furthermore, an anode of the diode Dc for preventing a countercurrent is electrically coupled between the ground terminal GND2 of the first driving IC 742 and the source terminal of the first switch YscL, and a cathode of the diode Dc for preventing a countercurrent is electrically coupled to the cathode of the control Zener diode ZDc. This diode Dc for preventing a countercurrent prevents a current from flowing from the gate terminal to the drain terminal of the second switch YscL when the second switch YscL is completely turned on by the second driving IC 744 during the address period AP when a voltage of the gate terminal of the second switch YscL is higher than a voltage of the drain terminal. Hence, the second switch YscL is not turned off and can maintain its turned-on state during the address period AP.

Hereinafter, the operation of the falling reset signal/scan low signal generating circuit 740 which applies a falling reset signal to the Y electrode during a falling period of the reset period RP and applies a scan low signal to the Y electrode during the address period AP will be described with reference to FIGS. 8 and 9*a* to 9*e*.

Figure 8:
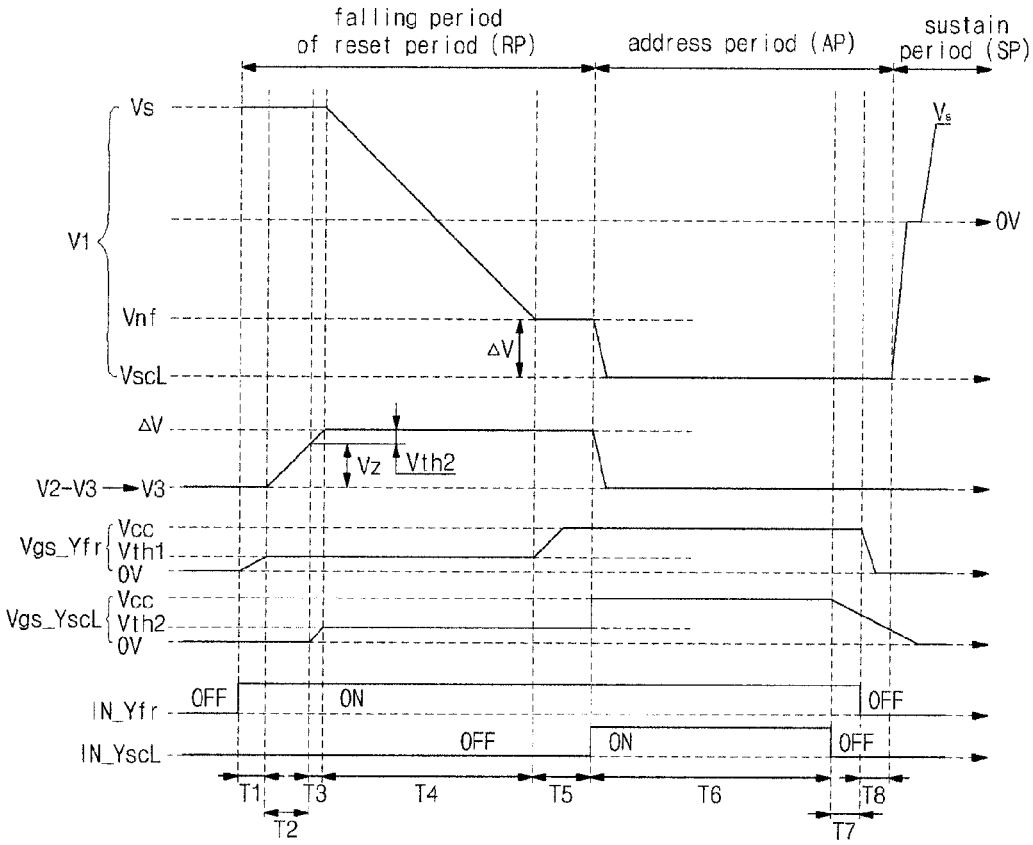
FIG. 8 is a view of an operation timing of a falling reset signal/scan low signal generating circuit illustrated in FIG. 7 during a falling period of a reset period and an address period.

FIG. 8 is a view of an operation timing of the falling reset signal/scan low signal generating circuit 740 of FIG. 7 during a falling period of the reset period and the address period, and FIGS. 9*a* to 9*e* are views of a current path in accordance with an operation of the falling reset signal/scan low signal generating circuit 740 illustrated in FIG. 7 during a falling period of the reset period and the address period.

Firstly, it is assumed that the switch Scl is turned on and the main control switch Ypn is turned off after a Vs voltage is applied to the panel capacitor Cp. Hence, a voltage V1 of a first node N1 to which the drain terminal of the first switch Yfr is coupled becomes the Vs voltage. In other words, a voltage of the drain terminal of the first switch Yfr becomes the Vs voltage. Here, a voltage of a second node N2 at which the ground line GL1 of the first driving IC 742 is coupled to the first switch Yfr and the second switch YscL is referred to as V2, and a voltage of a third node N3 at which the ground line GL2 of the second driving IC 744 is coupled to the second switch YscL and the VscL voltage source is referred to as V3.

In a driving method of a plasma display device according to another embodiment of the present invention, a method of applying a falling reset signal to the Y electrode during a falling period of the reset period RP and applying a scan low signal to the Y electrode during the address period AP includes a first step of turning on the first switch Yfr electrically coupled between the Y electrode and the VscL voltage source, a second step of repeating the turn-on and turn-off actions of the second switch YscL which is coupled in series between the first switch Yfr and the VscL voltage source to apply a falling reset signal which is decreased from the Vs voltage to the Vnf voltage to the Y electrode, and a third step of turning on the second switch YscL to apply a scan low signal having a scan low voltage to the Y electrode.

Figure 9A:
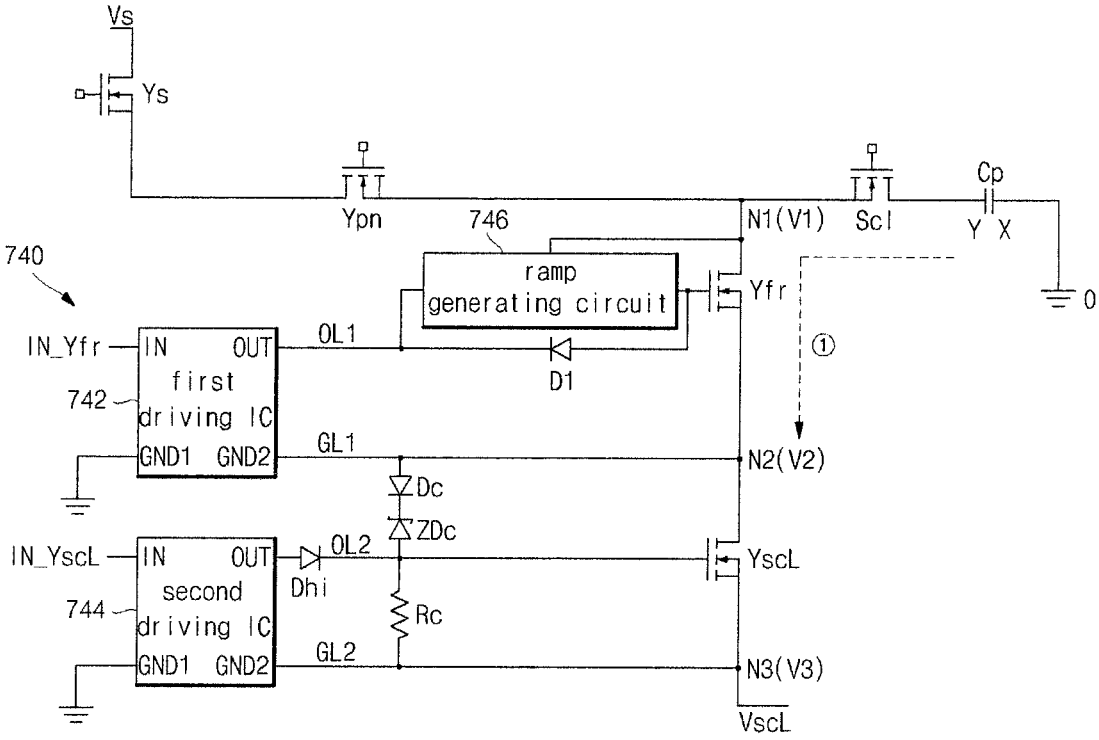
FIGS. 9*a* to 9*e* are views of a current path in accordance with an operation of the falling reset signal/scan low signal generating circuit illustrated in FIG. 7 during a falling period of a reset period and an address period.

As illustrated in FIG. 8, in the section (or period) T1, when the control signal IN_Yfr having a high level is applied to the control signal input terminal IN of the first driving IC 742, the operation voltage Vcc, which is a voltage difference between the output terminal OUT and the ground terminal GND2 of the first driving IC 742, is applied to the first switch Yfr. Hence, when a voltage Vgs_Yfr between a gate and a source of the first switch Yfr increases and reaches a threshold voltage Vth1 of the first switch Yfr, the first switch Yfr is turned on. Then, as illustrated in FIG. 9*a*, a current flows from the first node N1 to the second node N2 ①. At this time, the output of the second driving IC 744 is in a high impedance state.

In section (or period) T2, as long as the first switch Yfr is turned on and the following Equation 7 is satisfied, the voltage V2 of the second node N2 is increased, and a voltage between a drain and a source of the first switch Yfr is decreased in such a state that the voltage V1 of the first node N1 almost does not drop. This phenomenon occurs because a capacitance between a drain and a source of the second switch YscL is very small compared with a load of the panel capacitor Cp. Here, because the output of the second driving IC 744 is in a high impedance state, a voltage Vgs_YscL between a gate and a source of the second switch YscL continuously maintains 0V by the control resistor Rc.

$$(V2-V3)<Vz \qquad \text{Equation 7}$$

Here, V2–V3 is a voltage between the drain terminal and the source terminal of the second switch YscL, and Vz is a voltage between the ends of the control Zener diode ZDc.

Figure 9B:
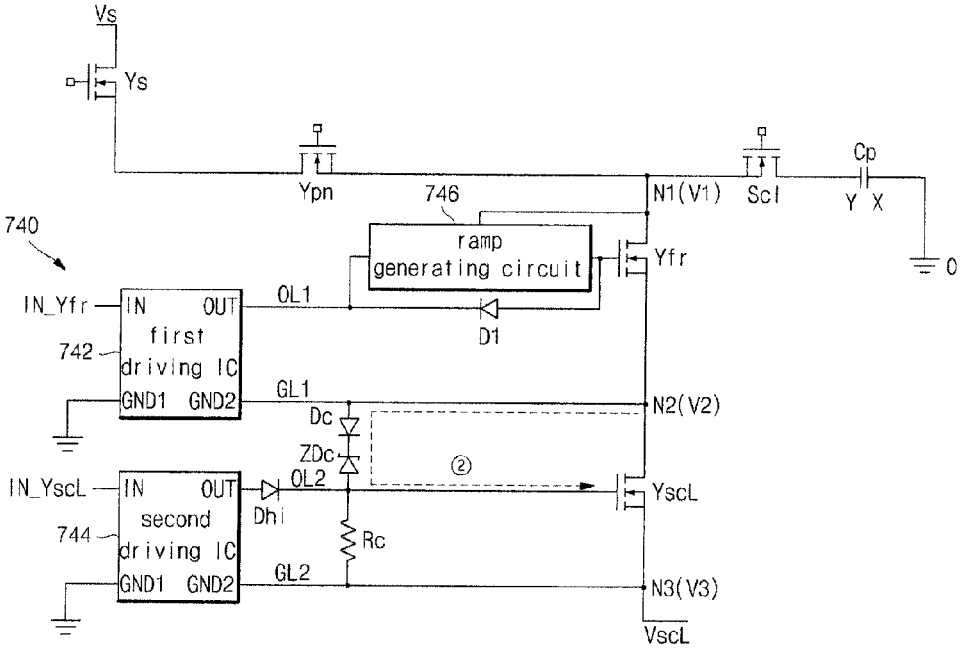

In section (or period) T3, when the voltage V2 of the second node N2 increases and satisfies the following Equation 8, a current flows to the gate terminal of the second switch YscL through the control Zener diode ZDc as illustrated in FIG. 9*b*, and a voltage Vgs_YscL between a gate and a source of the second switch YscL starts to increase ②.

$$(V2-V3)>Vz \qquad \text{Equation 8}$$

Furthermore, if a voltage Vgs_YscL between a gate and a source of the second switch YscL is continuously increased, then the result shown in the following Equation 9 is attained. Here, Vth2 is a threshold voltage of the second switch YscL.

$$(V2-V3)=Vz+Vth2 \qquad \text{Equation 9}$$

Figure 9C:
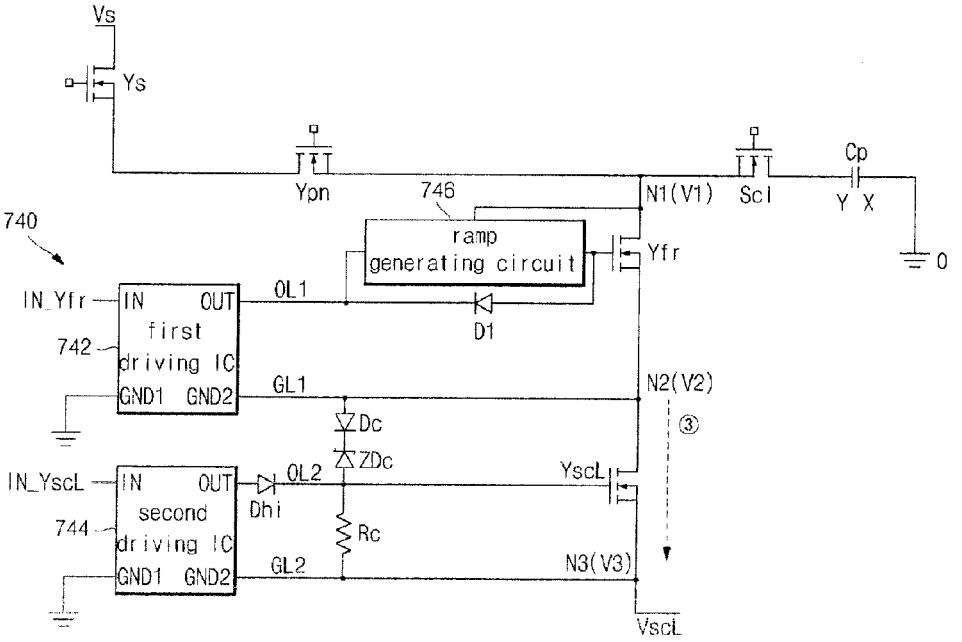
Figure 9D:
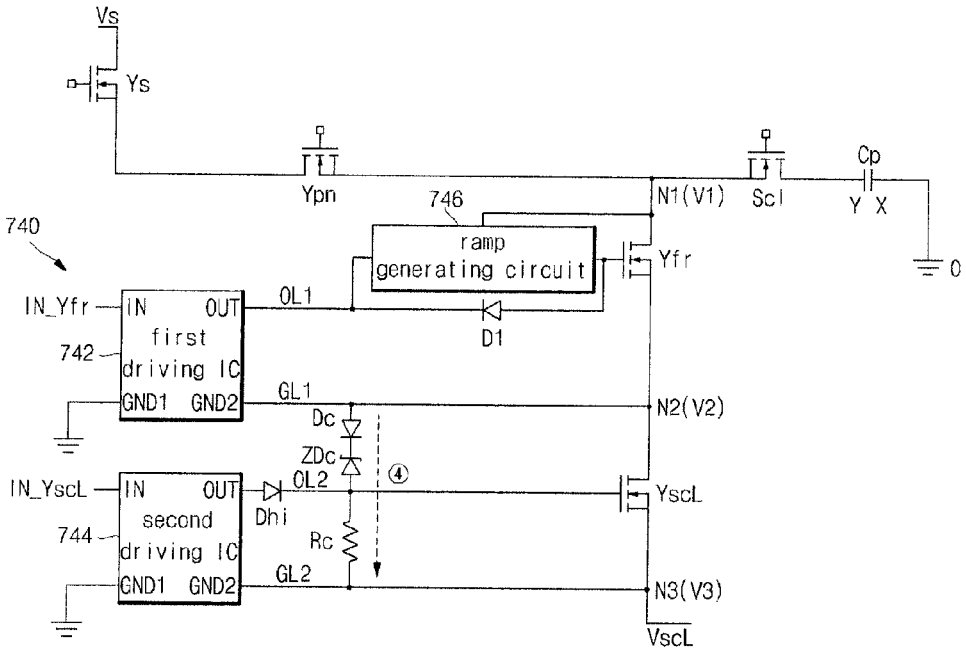

In section (or period) T4, if a current entered from the first node N1 to the second node N2 increases the voltage V2 of the second node N2 while the first switch Yfr is turned on, then a voltage Vgs_YscL between a gate and a source of the second switch YscL is increased above a threshold voltage Vth2 of the second switch YscL by the following Equation 10. Hence, as illustrated in FIG. 9*c*, the second switch YscL is turned on, and a current flows from the second node N2 to the third node N3, and the voltage V2 of the second node N2 is decreased ③. As described above, if the voltage V2 of the second node N2 is decreased, then a current does not flow through the control Zener diode ZDc, so that a current flows through the control resistor Rc as illustrated in FIG. 9*d*, and a voltage Vgs_YscL between a gate and a source of the second switch YscL is decreased ④. Hence, the second switch YscL is turned off. If the second switch YscL is turned off, then the voltage V2 of the second node N2 is increased by a current entered through the first switch Yfr. Then, the following Equation 10 is satisfied again, and thus the second switch YscL is turned on again.

$$Vgs_YscL=(V2-V3)-Vz \qquad \text{Equation 10}$$

The aforementioned operations are repeated, and thus the result shown in the following Equation 11 is maintained all through section T4. Which is, V2=V3+ΔV is maintained, and the voltage V1 of the first node N1 is continuously decreased, and thus the shape of a falling reset signal is made.

$$(V2-V3)=Vz+Vth2=\Delta V \quad \text{Equation 11}$$

Here, ΔV is defined as a certain voltage difference (ΔV of FIG. 2) between the Vnf voltage of a falling reset signal applied to the Y electrode during a falling period of the reset period RP and the VscL voltage of a scan low signal applied to the Y electrode during the address period AP, and is the same as a voltage V2−V3 between the drain terminal and the source terminal of the second switch YscL. This voltage V2−V3 between the drain terminal and the source terminal of the second switch YscL is a voltage which is produced by adding the voltage Vz between the ends of the control Zener diode ZDc and the threshold voltage Vth2 of the second switch YscL and can be adjusted by the voltage Vz between the ends of the control Zener diode ZDc and the threshold voltage Vth2 of the second switch YscL. For example, when ΔV is set to 25 volts, a circuit in which the control Zener diode ZDc having the voltage Vz of 20 volts between the ends and the second switch YscL having the threshold voltage Vth2 of 5 volts are arranged can be provided.

In section T5, if the voltage V1 of the first node N1 is finally the same as the voltage V2 of the second node N2, then the result shown in the following Equation 12 is attained.

$$V1=V2-V3=\Delta V \quad \text{Equation 12}$$

Furthermore, the voltage Vgs_Yfr between a gate and a source of the first switch Yfr is gradually increased and becomes the operation voltage Vcc, so that the first switch Yfr is completely turned on, and the voltage Vgs_YscL between a gate and a source of the second switch YscL is maintained in a slightly turned-off state by the control resistor Rc in a state of the threshold voltage Vth2 of the second switch YscL.

Figure 9E:
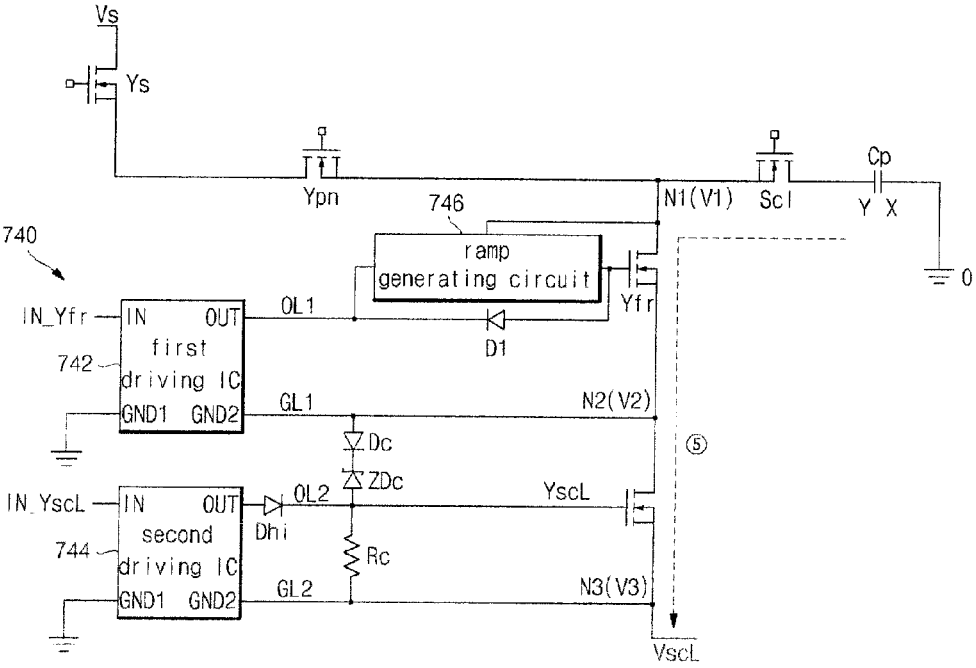

In section (or period) T6, when the control signal IN_YscL having a high level is applied to the control signal input terminal IN of the second driving IC 744, the output of the second driving IC 744 leaves a high impedance state, and the operation voltage Vcc, which is a voltage difference between the output terminal VO and the ground terminal GND2 of the second driving IC 744, is applied to the second switch YscL. Hence, the voltage Vgs_YscL between a gate and a source of the second switch YscL increases and becomes the operation voltage Vcc above the threshold voltage Vth2 of the second switch YscL, so that the second switch YscL is completely turned on, and the second node N2 is coupled to the third node N3 as illustrated in FIG. 9*e* ⑤. Furthermore, because the first switch Yfr is in a completely turned-on state, the voltage V1 of the first node N1 becomes the voltage V3 of the third node, which is, the VscL voltage. Hence, when an address signal having the Va voltage is applied to the A electrode during the address period AP and an address discharge is carried out, the voltage V1 of the first node N1 can be maintained at the VscL voltage without disturbance in such a state that the first switch Yfr and the second switch YscL are tuned on. Because the voltage V1 of the first node N1 is maintained at the VscL voltage without disturbance by the first switch Yfr and the second switch YscL during the address period AP, less stress is applied to each of the first switch Yfr and the second switch YscL. Furthermore, because the first switch Yfr allows a bias current to flow to the second switch YscL while the VscL voltage is applied to the Y electrode of a cell to be turned on during the address period AP, the second switch YscL has a low withstanding voltage (approximately 25 volts) of a Vnf−VscL. Here, when the second switch YscL is completely turned on by the second driving IC 744 during the address period AP and a voltage of the gate terminal of the second switch YscL is higher than a voltage of the drain terminal, a current can flow from the gate terminal to the drain terminal of the second switch YscL, and the diode Dc for preventing a countercurrent blocks the current flow from the gate terminal to the drain terminal of the second switch YscL. Hence, the second switch YscL is not turned off and can maintain its turned-on state during the address period AP.

In section (or period) T7, if the control input signal IN_YscL of the second switch YscL is not inputted, then the output of the second driving IC 744 is in a high impedance state, and the voltage Vgs_YscL between a gate and a source of the second switch YscL is slowly decreased.

In section (or period) T8, if the control input signal IN_Yfr of the first switch Yfr is not inputted, then the first switch Yfr is completely turned off.

After section (or period) T8, when the main control switches Ypp and Ypn and the switch Scl of the selection circuit 760 are turned on, the sustain period SP begins.

As described above, the falling reset signal/scan low signal generating circuit 740 of a plasma display device according to another embodiment of the present invention couples the control Zener diode ZDc between the source terminal of the first switch Yfr and the gate terminal of the second switch YscL, so that it can adjust a voltage of the gate terminal of the second switch YscL by a voltage V2−V3 between the drain terminal and the source terminal of the second switch YscL and the control Zener diode ZDc. Hence, compared to the case where the control Zener diode ZDc is coupled between the gate terminal of the first switch Yfr and the gate terminal of the second switch YscL and a gate voltage of the second switch YscL is controlled by a voltage V2−V3 between the drain terminal and the source terminal of the second switch YscL, the operation voltage Vcc of the first driving IC 442 and the control Zener diode ZDc in the falling reset signal/scan low signal generating circuit 440 of a plasma display device according to an embodiment of the present invention, the falling reset signal/scan low signal generating circuit 740 of a plasma display device according to another embodiment of the present invention can easily make a withstanding voltage design.

As describe above, a plasma display device and a driving method thereof according to embodiments of the present invention couple the first switch Yfr and the second switch YscL between the Y electrode and the VscL voltage source in series and have the falling reset signal/scan low signal driver which is provided with the control Zener diode ZDc for adjusting the gate voltage of the second switch YscL and the control resistor Rc, and thus they reduce a withstanding voltage of a switch coupled between a scan electrode to which a high voltage is applied and a low voltage source having a low voltage, so that they can suppress the increase in manufacturing cost due to the use of a switch having a high withstanding voltage.

Furthermore, a plasma display device and a driving method thereof according to embodiments of the present invention can use a Zener diode having a low electric power as the Zener diode that controls a voltage of the gate terminal of the second switch YscL between the gate terminal of the first switch Yfr and the gate terminal of the second switch YscL or between the source terminal of the first switch Yfr and the gate terminal of the second switch YscL. Hence, it is possible to reduce the manufacturing cost of a plasma display device.

Moreover, a plasma display device and a driving method thereof according to a specific embodiment of the present invention couple the Zener diode for controlling a voltage of the gate terminal of the second switch YscL between the source terminal of the first switch Yfr and the gate terminal of the second switch YscL, and thus they can easily make a withstanding design of the second switch YscL.

Although exemplary embodiments of the present invention have been described for illustrative purpose, those skilled in the art will appreciate that various modifications and changes thereof are possible without departing from the scope and spirit of the present invention, and all modifications and changes are intended to be included within the description of the claims and their equivalents.

What is claimed is:

1. A plasma display device comprising:

a plasma display panel having a plurality of scan electrodes; and a scan driver coupled to the scan electrodes, the scan driver comprising a falling reset signal/scan low signal generating circuit, wherein the falling reset signal/scan low signal generating circuit comprises:

a first switch electrically coupled to a scan electrode among the plurality of scan electrodes;

a second switch coupled in series with the first switch;

a scan low voltage source having a scan low voltage and electrically coupled to the second switch;

a first driving circuit having an output terminal electrically coupled to a control terminal of the first switch and a ground terminal electrically coupled to a connection point of the first switch and the second switch;

a second driving circuit having an output terminal electrically coupled to a control terminal of the second switch and a ground terminal electrically coupled to a connection point of the second switch and the scan low voltage source;

a Zener diode electrically coupled between the ground terminal of the first driving circuit and the control terminal of the second switch;

a resistor electrically coupled between the control terminal of the second switch and the scan low voltage source; and a diode for preventing a countercurrent electrically coupled between the ground terminal of the first driving circuit and the Zener diode.

2. The plasma display device according to claim 1, wherein a first terminal of the first switch is electrically coupled to the scan electrode, and a second terminal of the first switch is electrically coupled to a first terminal of the second switch and the ground terminal of the first driving circuit, and a first terminal of the second switch is electrically coupled to the second terminal of the first switch and a cathode of the Zener diode, and a second terminal of the second switch is electrically coupled to the ground terminal of the second driving circuit and the resistor, and the control terminal of the second switch is electrically coupled to an anode of the Zener diode and the resistor, and an anode of the diode for preventing a countercurrent is electrically coupled to the ground terminal of the first driving circuit and the second terminal of the first switch, and a cathode of the diode for preventing a countercurrent is electrically coupled to the cathode of the Zener diode.

3. The plasma display device according to claim 2, wherein the first driving circuit has an input terminal, and when a high-level signal is inputted through the input terminal of the first driving circuit, an operation voltage, which is a voltage difference between the output terminal and the ground terminal of the first driving circuit, is applied to the first switch, so that the first switch is turned on, and the second driving circuit has an input terminal, and when a high-level signal is inputted through the input terminal of the second driving circuit, an operation voltage, which is a voltage difference between the output terminal and the ground terminal of the second driving circuit, is applied to the second switch, so that the second switch is turned on.

4. The plasma display device according to claim 3, further comprising:

a first voltage source having a first voltage and electrically coupled to the first terminal of the first switch and the scan electrode; and a main control switch electrically coupled between the first voltage source and the first terminal of the first switch.

5. The plasma display device according to claim 4, wherein during a rising period of a reset period, the main control switch is turned on, so that the first voltage is applied to the scan electrode.

6. The plasma display device according to claim 5, wherein during a falling period of the reset period, when the main control switch is turned off and the first switch is turned on by the first driving circuit, the turn-on and turn-off actions of the second switch are repeated, and a voltage of the first terminal of the second switch is constantly maintained, and a falling reset signal that decreases from the first voltage to a second voltage is applied to the scan electrode.

7. The plasma display device according to claim 6, wherein the second voltage is a voltage increased by a voltage between the first terminal and the second terminal of the second switch from the scan low voltage, and the voltage between the first terminal and the second terminal of the second switch is a voltage produced by adding a voltage between ends of the Zener diode and a threshold voltage of the second switch.

8. The plasma display device according to claim 6, wherein during an address period, the second switch is turned on by the second driving circuit, so that a scan low signal having the scan low voltage is applied to the scan electrode.

9. The plasma display device according to claim 2, wherein the falling reset signal/scan low signal generating circuit further comprises a ramp generating circuit having a first terminal electrically coupled to the scan electrode and the first terminal of the first switch, a second terminal electrically coupled to the control terminal of the first switch, and a third terminal electrically coupled to the output terminal of the first driving circuit.

10. The plasma display device according to claim 9, wherein the ramp generating circuit comprises:

a ramp generating circuit resistor electrically coupled to the first terminal of the first switch; and a capacitor electrically coupled between the ramp generating circuit resistor and the control terminal of the first switch.

11. The plasma display device according to claim 9, wherein the falling reset signal/scan low signal generating circuit further comprises a diode having an anode electrically coupled to the control terminal of the first switch and the second terminal of the ramp generating circuit and a cathode electrically coupled to the output terminal of the first driving circuit and the third terminal of the ramp generating circuit.

12. The plasma display device according to claim 1, wherein the falling reset signal/scan low signal generating circuit further comprises a diode electrically coupled between the output terminal of the second driving circuit and the Zener diode.

13. The plasma display device according to claim 1, wherein the falling reset signal/scan low signal generating circuit further comprises a switch electrically coupled between the output terminal of the second driving circuit and the Zener diode.

* * * * *